US009067721B2

(12) United States Patent
Mullaney

(10) Patent No.: US 9,067,721 B2
(45) Date of Patent: Jun. 30, 2015

(54) HEIGHT ADJUSTABLE SHIPPING CONTAINER

(71) Applicant: LIFTING POINT PTY LTD, Penrith, New South Wales (AU)

(72) Inventor: Nicholas Bruce Mullaney, Marulan (AU)

(73) Assignee: LIFTING POINT PTY LTD. (AU)

( * ) Notice: Subject to any disclaimer, the term of this patent is extended or adjusted under 35 U.S.C. 154(b) by 0 days.

(21) Appl. No.: 14/379,220

(22) PCT Filed: Feb. 12, 2013

(86) PCT No.: PCT/AU2013/000117

§ 371 (c)(1),
(2) Date: Aug. 15, 2014

(87) PCT Pub. No.: WO2013/120129

PCT Pub. Date: Aug. 22, 2013

(65) Prior Publication Data

US 2015/0034634 A1 Feb. 5, 2015

(30) Foreign Application Priority Data

Feb. 17, 2012 (AU) ..... 2012900570

(51) Int. Cl.
*B65D 88/00* (2006.01)
*E04B 1/343* (2006.01)
(Continued)

(52) U.S. Cl.
CPC ..... *B65D 88/005* (2013.01); *E04B 1/3431* (2013.01); *E04B 1/3442* (2013.01); *E04B 1/3483* (2013.01); *E04B 2001/34389* (2013.01);
(Continued)

(58) Field of Classification Search
CPC ..... B65D 88/005; B65D 88/121
USPC ..... 220/8, 1.5, 4.28, 666; 52/66, 64, 71, 52/79.5, 79.9
See application file for complete search history.

(56) References Cited

U.S. PATENT DOCUMENTS 4,506,798 A 3/1985 Goutille
4,722,156 A 2/1988 Sato
(Continued)

FOREIGN PATENT DOCUMENTS

EP 0049599 4/1982
EP 2327345 6/2011
(Continued)

OTHER PUBLICATIONS

International Search Report for PCT/AU2013/000117, Completed by the Australian Patent Office on Apr. 5, 2013, 6 Pages.
(Continued)

*Primary Examiner* — Steven A. Reynolds
*Assistant Examiner* — King M Chu
(74) *Attorney, Agent, or Firm* — Brooks Kushman P.C.

(57) ABSTRACT

A height adjustable shipping container usable as a building structure. The container having vertical corner columns and at least three side walls which may be transported at a reduced height as a shipping container and expanded at the receiving end. At least some of the vertical corner columns expand in length during expansion of the reduced height shipping container. The shipping container is able to transport therein structural components, such as wall, panel, roof and even fittings to build a building structure that is the equivalent in floor area to that of at least two shipping containers.

20 Claims, 28 Drawing Sheets

(51) Int. Cl.

| | |
|---|---|
| ***E04B 1/344*** | (2006.01) |
| ***B28B 13/00*** | (2006.01) |
| ***E04G 11/36*** | (2006.01) |
| ***B65D 90/00*** | (2006.01) |
| ***B65D 90/02*** | (2006.01) |
| ***B65D 88/12*** | (2006.01) |
| ***B65D 90/06*** | (2006.01) |
| ***E04H 9/16*** | (2006.01) |
| *E04B 1/348* | (2006.01) |
| *E04H 1/12* | (2006.01) |

(52) U.S. Cl.

CPC ..... *E04B2001/34876* (2013.01); *E04B 2001/34884* (2013.01); *E04H 2001/1283* (2013.01); *B28B 13/00* (2013.01); *E04G 11/36* (2013.01); *B65D 90/0026* (2013.01); *B65D 90/0033* (2013.01); *B65D 90/02* (2013.01); *B65D 88/12* (2013.01); *B65D 90/023* (2013.01); *B65D 90/06* (2013.01); *E04B 1/34305* (2013.01); *E04B 1/34336* (2013.01); *E04H 1/12* (2013.01); *E04H 9/16* (2013.01)

(56) References Cited

U.S. PATENT DOCUMENTS

| | | | | |
|---|---|---|---|---|
| 6,112,929 | A * | 9/2000 | Ota | 220/8 |
| 6,227,397 | B1 * | 5/2001 | Kim | 220/8 |
| 2010/0269419 | A1 * | 10/2010 | Gyory et al. | 52/79.5 |
| 2011/0023925 | A1 * | 2/2011 | Johnson et al. | 135/139 |
| 2011/0120026 | A1 * | 5/2011 | Hache | 52/79.5 |
| 2011/0297675 | A1 * | 12/2011 | Johnson et al. | 220/8 |

FOREIGN PATENT DOCUMENTS

| | | |
|---|---|---|
| GB | 1505866 | 3/1978 |
| GB | 2085507 | 4/1982 |
| GB | 2345282 | 7/2000 |
| GB | 2406560 | 4/2005 |

OTHER PUBLICATIONS

Written Opinion for PCT/AU2013/000117, Completed by the Australian Patent Office, Dated Apr. 5, 2013, 8 Pages.

* cited by examiner

HEIGHT ADJUSTABLE SHIPPING CONTAINER

CROSS-REFERENCE TO RELATED APPLICATION

This application is the U.S. national phase of PCT Application No. PCT/AU2013/000117 filed on Feb. 12, 2013, which claims priority to AU Patent Application No. 2012900570 filed on Feb. 17, 2012, the disclosures of which are incorporated in their entirety by reference herein.

FIELD OF THE INVENTION

The invention relates to a Height Adjustable Shipping Container for use as a building structure, typically for housing and/or mining accommodation.

BACKGROUND OF INVENTION

A problem with existing methods of shipping standard shipping containers lies in the height and transport costs of a product which does not take up the full space within the container particularly where the container is to be used as some form of accommodation or commercial use. In such cases the interior of the container is often almost empty but because the eventual residential height in the container is full height the transport costs are high.

Equally, where accommodation which is greater than the height of a shipping container must be provided the only real option is to provide it as two containers, one without floor, which must be mounted on top of each other.

PRIOR REFERENCES

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications may be referred to herein; this reference does not constitute an admission that any of these documents form part of the common general knowledge in the art, in New Zealand or in any other country.

Object of the Invention

It is an object of the invention to provide a height adjustable shipping container that ameliorates some of the disadvantages and limitations of the known art or at least provide the public with a useful choice.

SUMMARY OF INVENTION

In a first aspect the invention resides in a height adjustable shipping container usable as a building and having vertical corner members and at least three side walls which may be transported at a reduced height as a shipping container and expanded at the receiving end wherein at least some of the vertical corner members expand in length during expansion of the reduced height shipping container.

Preferably the vertical corner members are vertical rails or columns.

Preferably at least some part of a side wall is attached to an upper part of the height adjustable container during expansion.

Preferably at least some other part of a side wall is attached to the lower part of the height adjustable container during expansion.

Preferably the lower part of the side walls is substantially high enough to accommodate furniture below its height.

Preferably the lower part of the side walls is substantially 0.9 meters high.

Preferably the upper part of the side walls is substantially 0.3 meters high.

Preferably access points for utility services are at the junctures of the upper and lower walls.

Preferably at least part of a wall filling the gap between upper and lower shipping container parts is pulled into place on expansion of the container.

Preferably elements forming the shipping container walls during transport may be relocated elsewhere within the container after expansion.

Preferably the shipping container top surface is angled with respect to the plane of the floor.

Preferably two such expanded top surfaces may be placed side by side to form a peaked pitched roof.

Preferably the floor of the shipping container may act to receive a pourable settable material and may include elements acting as reinforcement for the settable material.

Preferably the reinforcement elements may extend through two adjacent expanded shipping container floors.

Preferably the shipping container corner members may include telescoping portions in which any engagement features in the corner rail top are substantially repeated in the top of each telescoping portion.

Preferably in the expanded form the corner members remain capable of supporting vertical loads.

Preferably, the expandable vertical members include a horizontally extending channel to support a portion of a load bearing beam adapted to extend between two spaced apart expandable vertical members.

Preferably, the floor includes spaced apart openings adapted to receive the tines of a fork lift to allow the unerected shipping container to be easily transported and are adapted when the shipping container is erected to used as service ducts.

In another aspect as herein described the invention relates to a method of manufacturing an expandable shipping container by:

(i) providing a container base and expandable vertical members, the members when not expanded extending to a packaged height, providing at least one first vertical wall portion attached to the base and extending less than the packaged height of the container, providing an upper surface secured at least at one position to an upper portion of an expandable vertical member, providing at least one second vertical wall portion extending towards the first vertical wall portion from the upper surface;

(ii) extending the members to an expanded position further spacing the first vertical wall portion from the second vertical wall portion.

BRIEF DESCRIPTION

The invention will now be described, by way of example only, by reference to the accompanying drawings.

Figure 21:
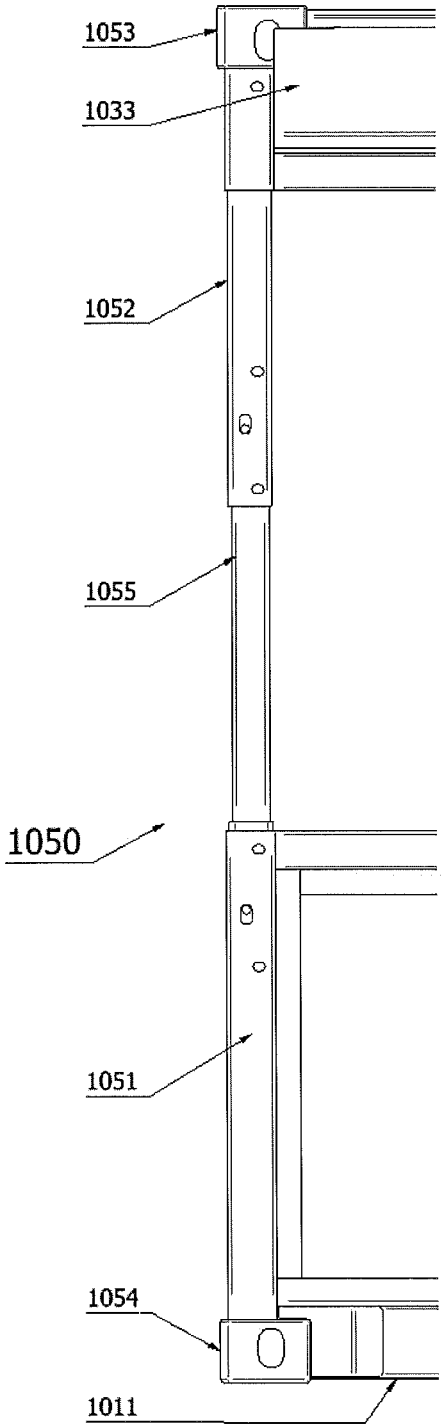

FIG. 21 a side view detail of a telescoping expanding vertical container column.

Figure 22:
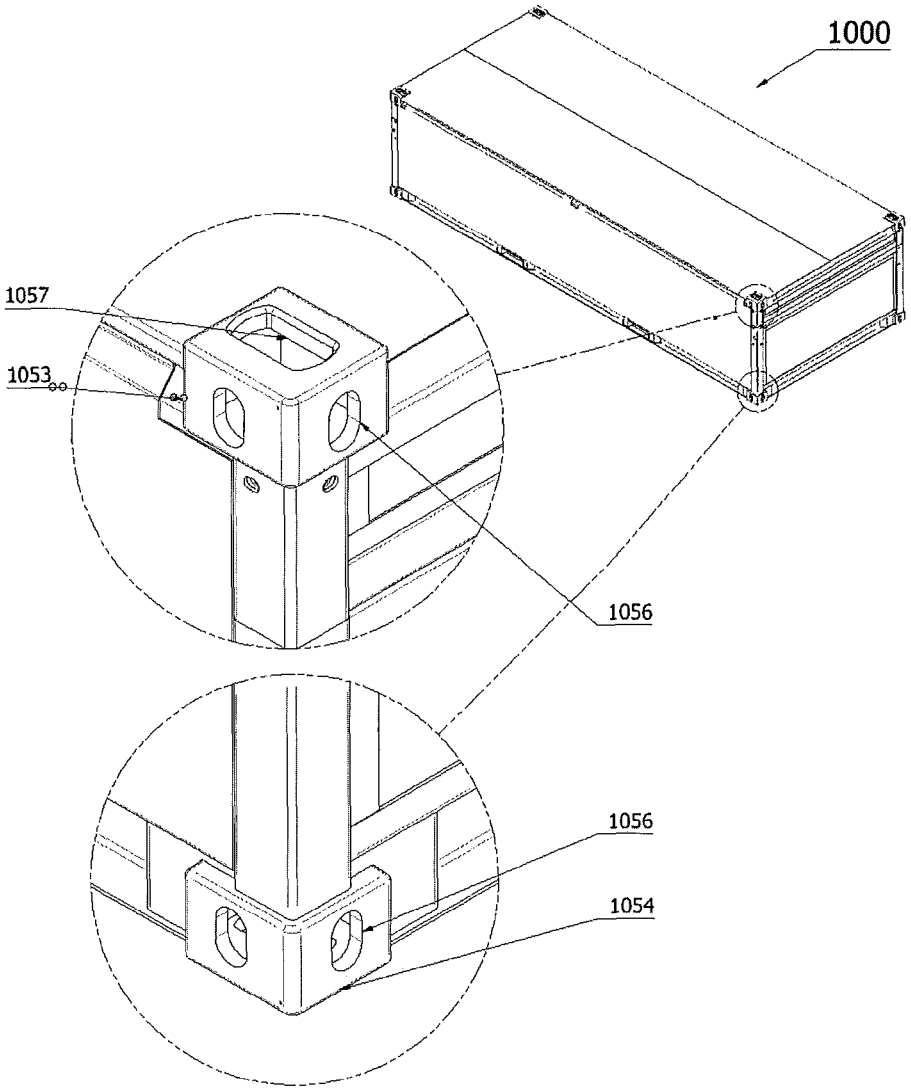

FIG. 22 is a detail of the lower and upper portions of the column shown in FIG. 21.

Figure 12:
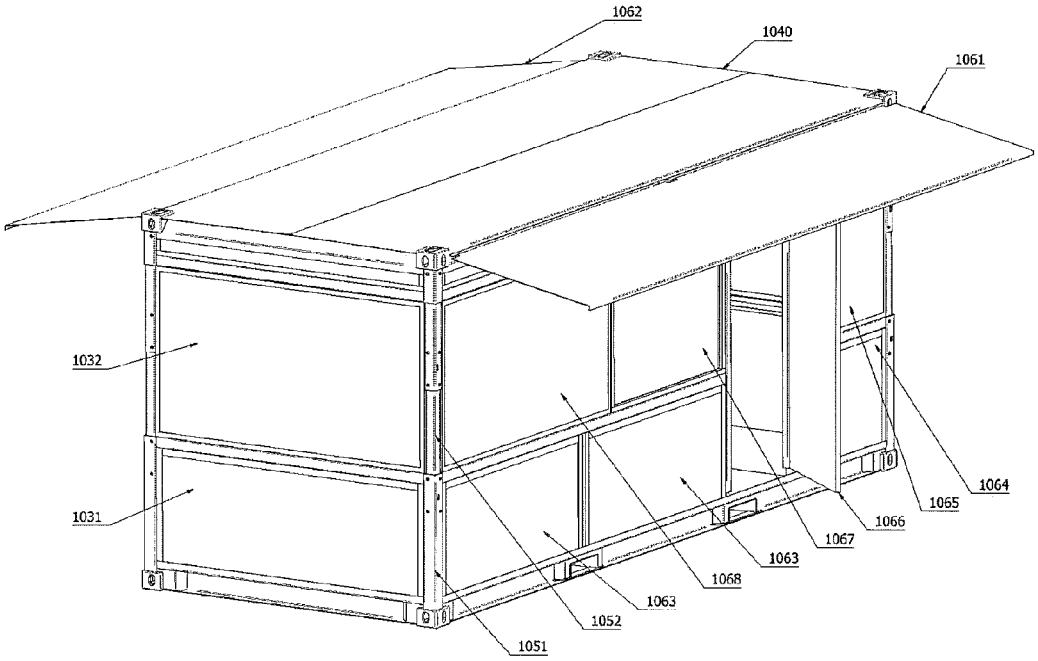
FIG. 12 is a perspective view of the container shown in FIG. 11 in expanded form.
Figure 23:
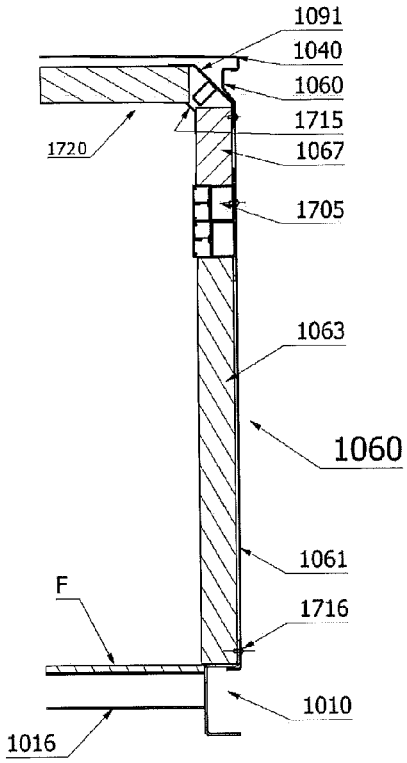

FIG. 23 is a side cross-sectional view of part of the container as shown in FIG. 12.

Figure 24:
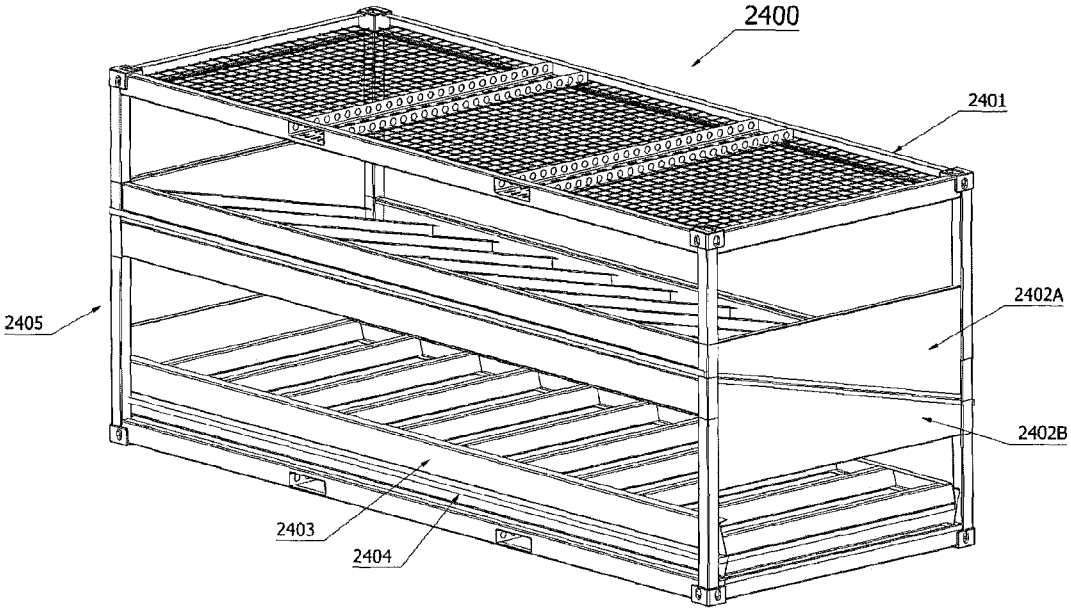

FIG. 24 is a perspective view of a packaged unerected container in accordance with a third preferred embodiment of the invention.

Figure 24A:
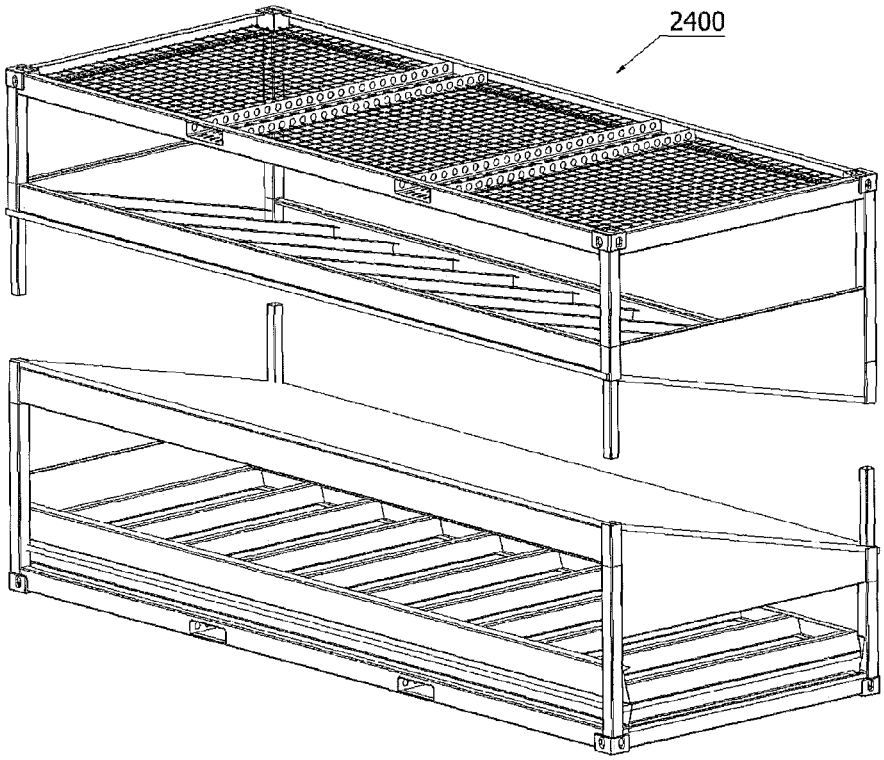

FIG. 24A is a perspective exploded view of the container as shown in FIG. 24.

Figure 24C:
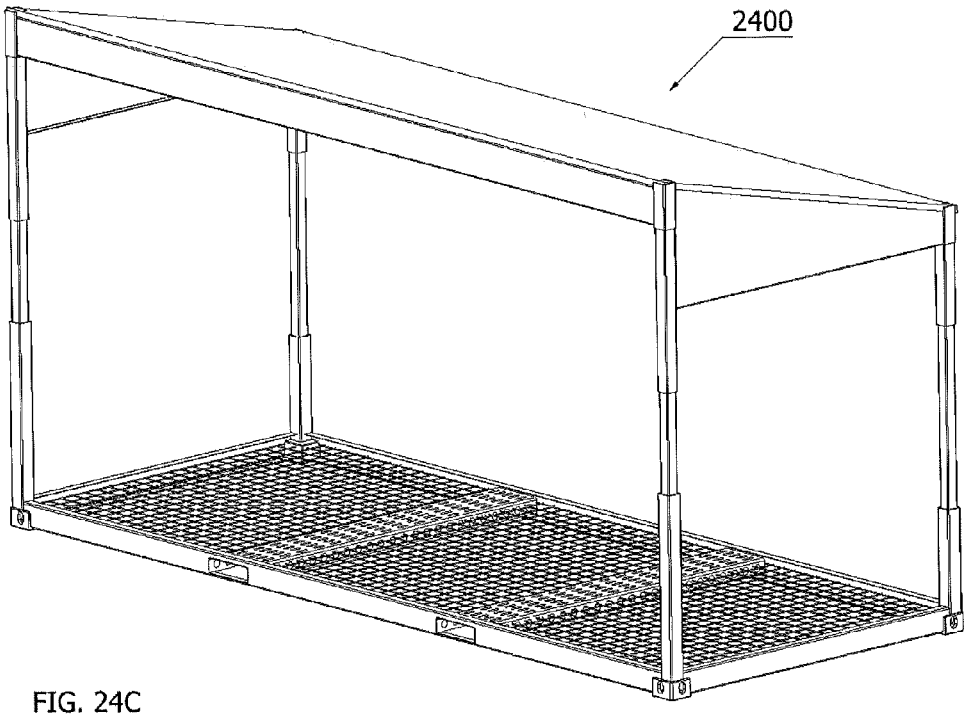

FIG. 24C is a perspective view of the container as shown in FIG. 24 in an erected state.

Figure 24D:
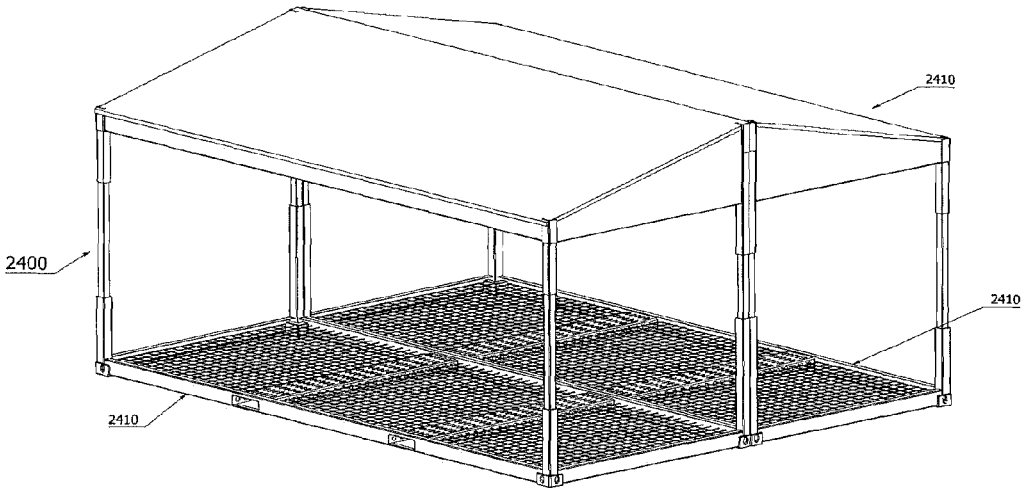

FIG. 24D is a perspective view of an assembled building.

Figure 24E:
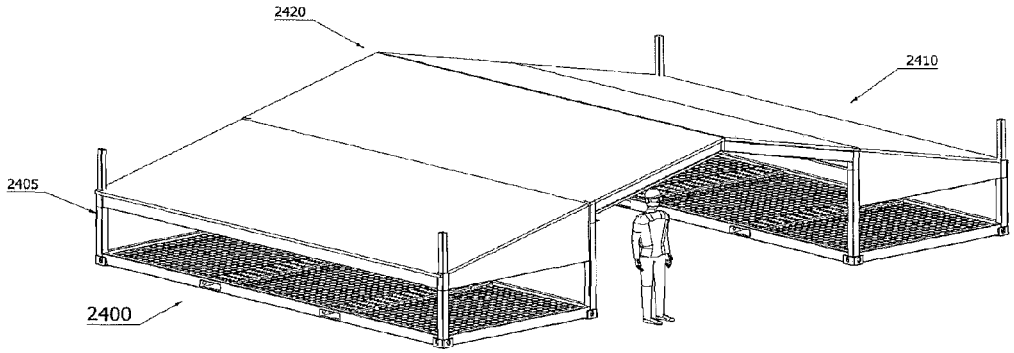

FIG. 24E is a perspective view of a further partially assembled building created from two containers as shown in FIG. 24.

Figure 24F:
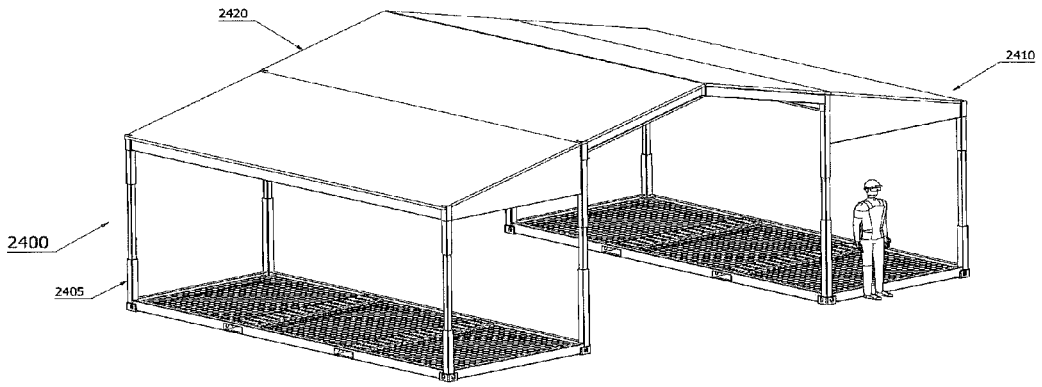

FIG. 24F is a perspective view of a fully assembled building as shown in FIG. 24E.

Figure 24G:
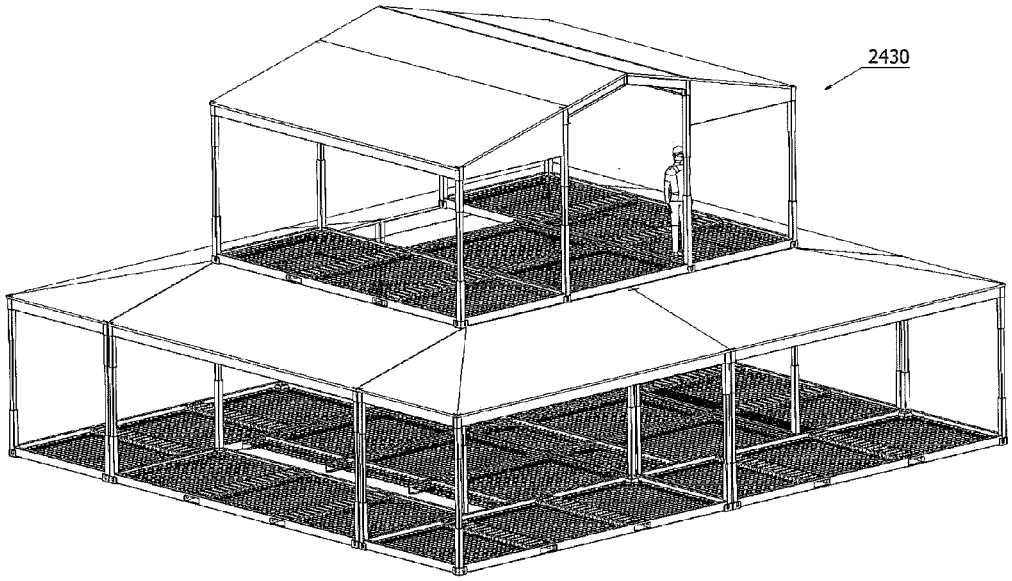

FIG. 24G is a perspective view of another assembled building.

Figure 24H:
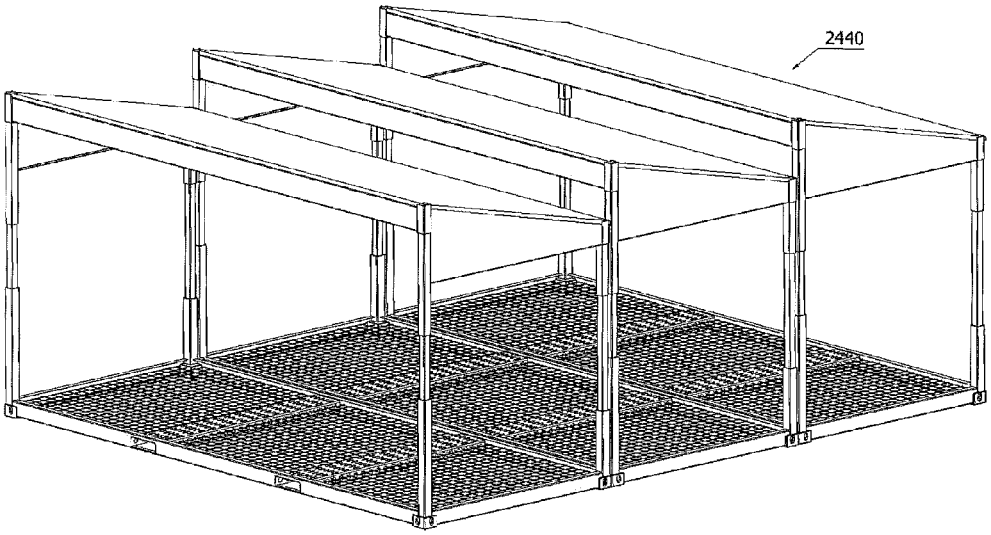

FIG. 24H is a perspective view of another partially assembled building.

Figure 24I:
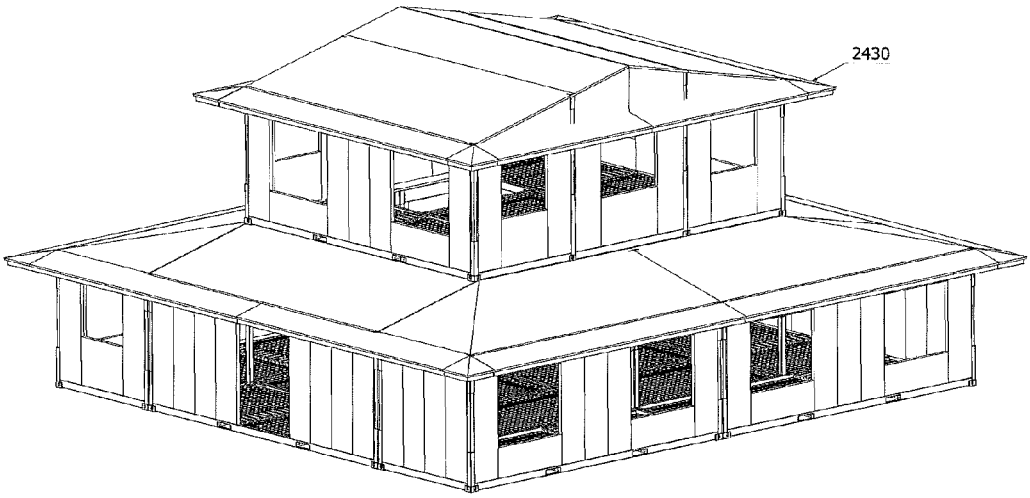

FIG. 24I is a perspective view of the building as shown in FIG. 24G in a completed state.

Figure 24J:
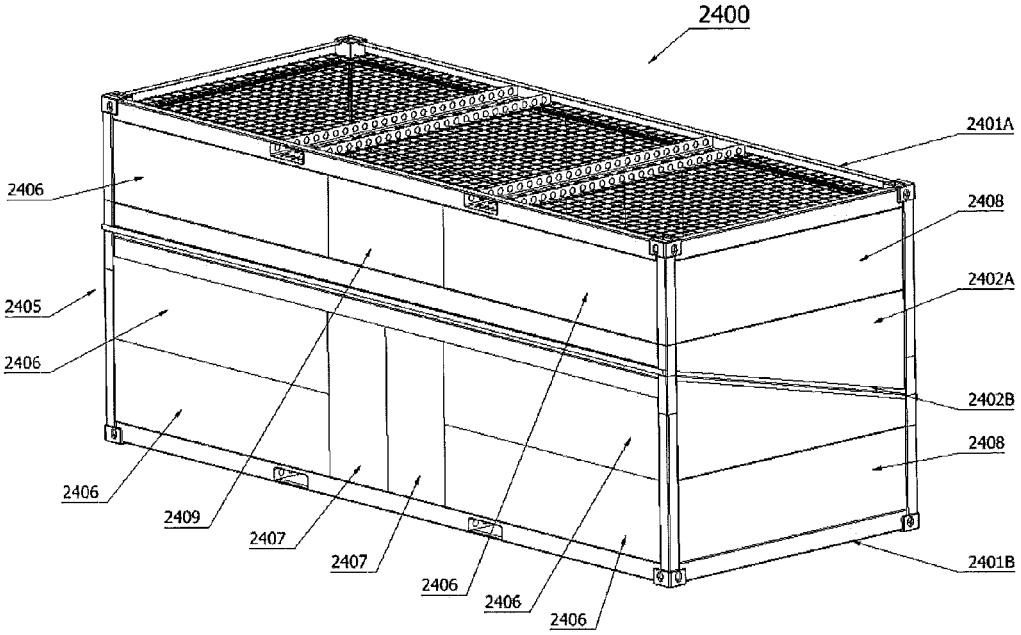

FIG. 24J is a perspective view of a container ready for transport.

Figure 24K:
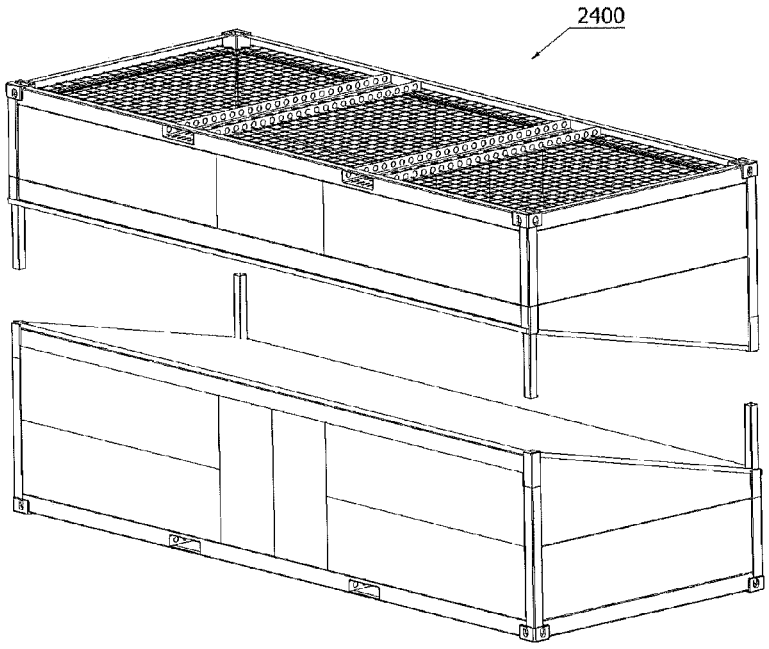

FIG. 24K is an partial exploded view of the container shown in FIG. 24J

Figure 25:
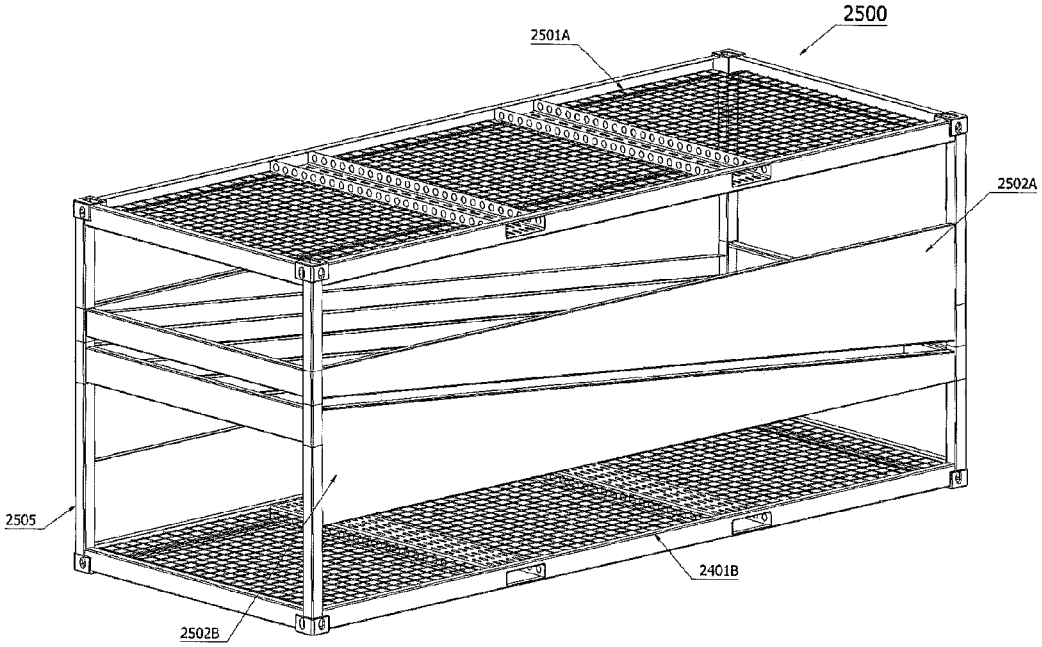

FIG. 25 is a perspective view of a packaged unerected container in accordance with a fourth preferred embodiment of the invention.

Figure 25A:
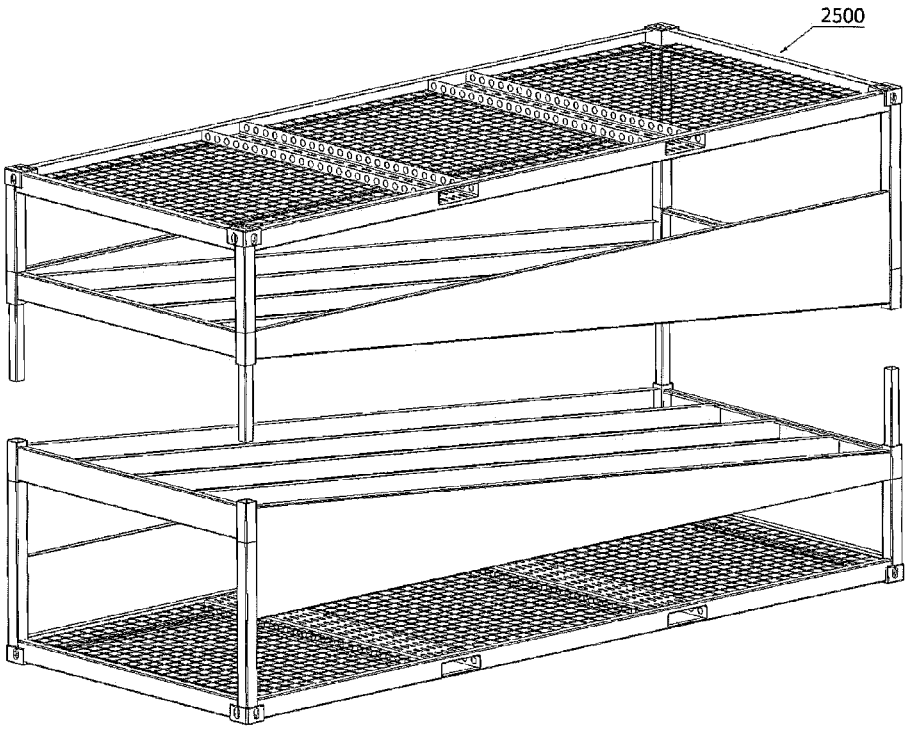

FIG. 25A is a perspective exploded view of the container as shown in FIG. 25.

Figure 25B:
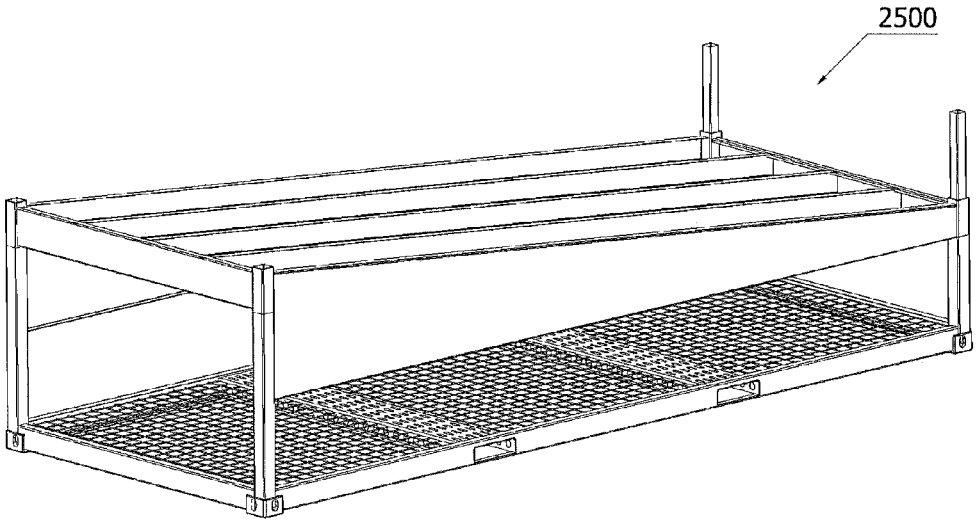

FIG. 25B is a perspective view of the lower part of the packaged unerected container as shown in FIG. 25.

Figure 25C:
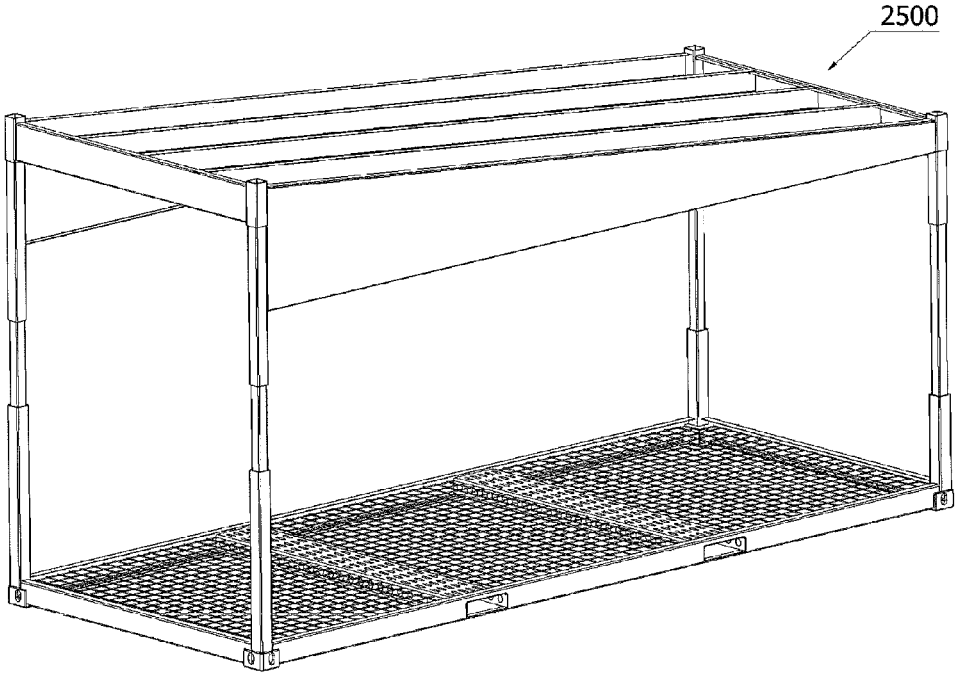

FIG. 25C is a perspective view of the container as shown in FIG. 25 in an erected state.

Figure 25D:
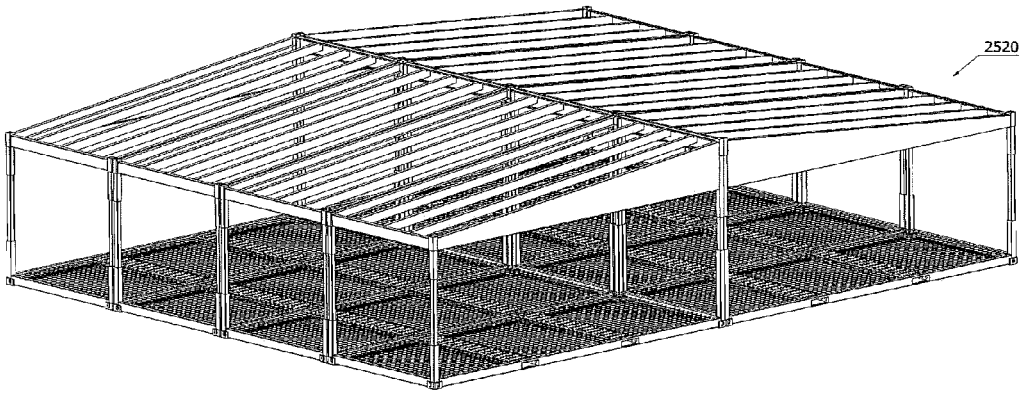

FIG. 25D is a perspective view of an assembled building.

Figure 26:
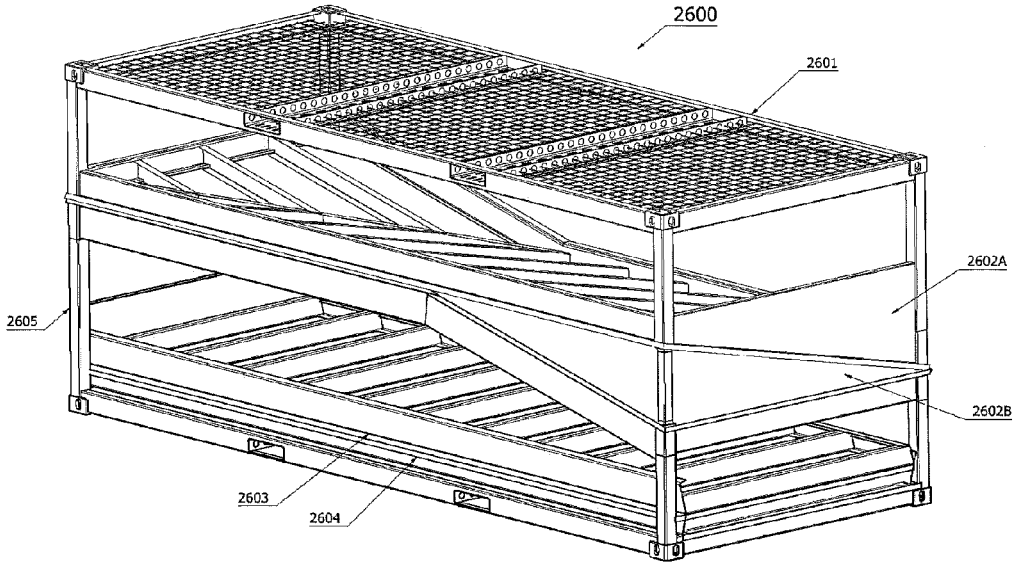

FIG. 26 is a perspective view of a packaged unerected container in accordance with a fifth preferred embodiment of the invention.

Figure 26A:
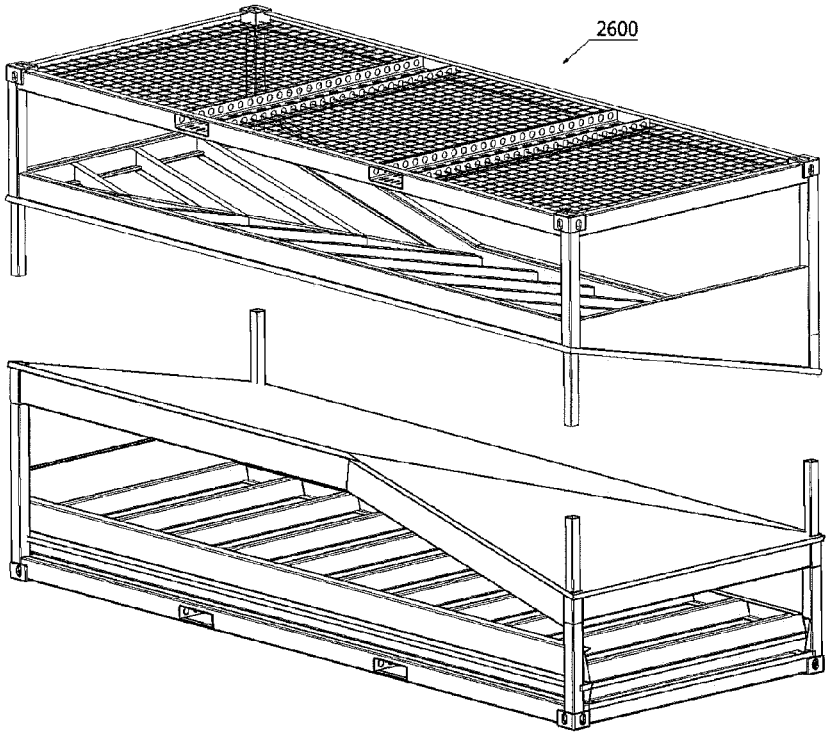

FIG. 26A is a perspective exploded view of the container as shown in FIG. 26.

Figure 26B:
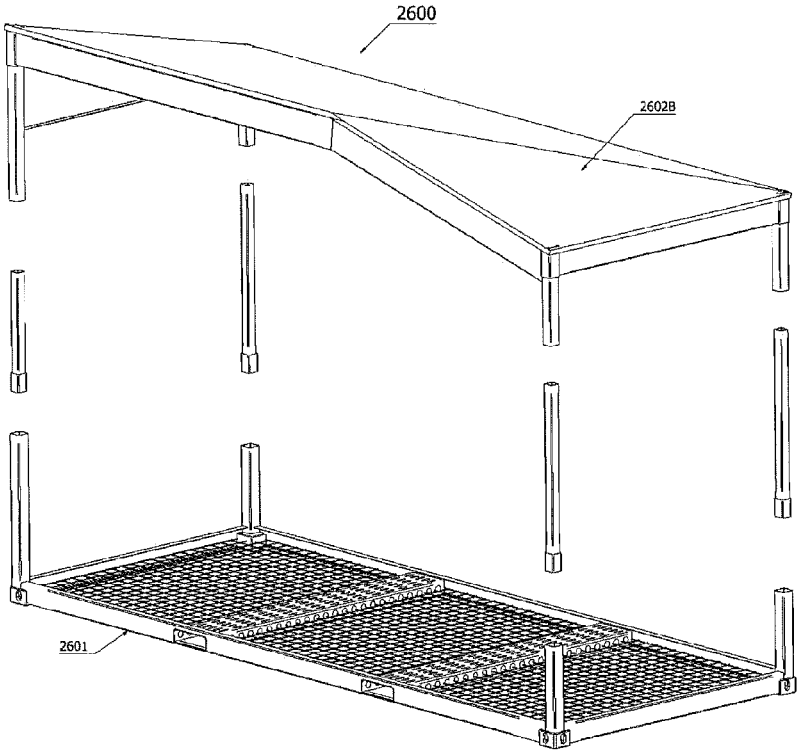

FIG. 26B is a perspective exploded view of the container as shown in FIG. 26 in an erected state.

Figure 26C:
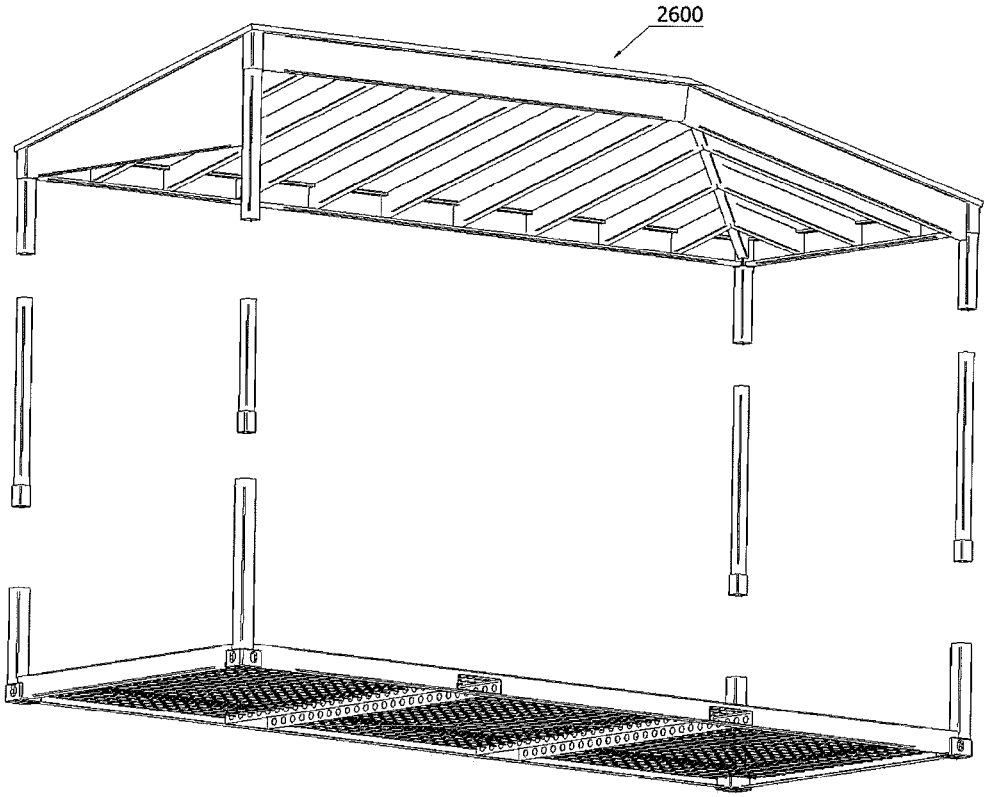

FIG. 26C is a further perspective exploded view of the container as shown in FIG. 26 in an erected state.

Figure 26D:
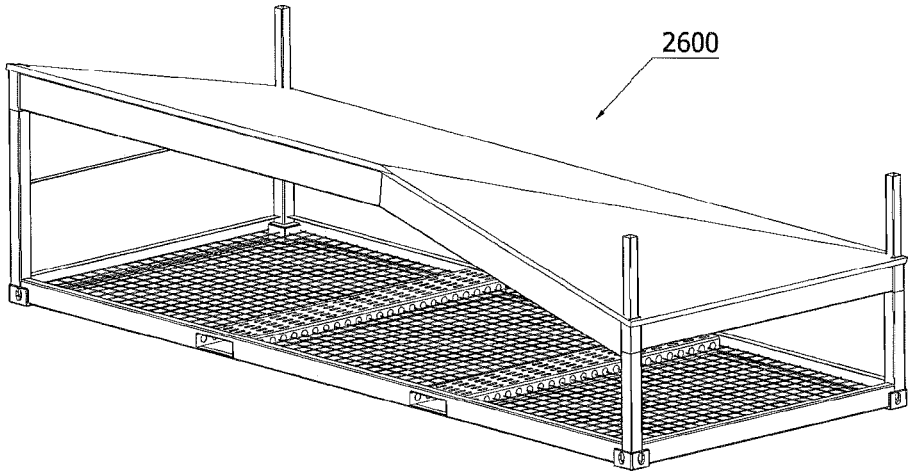

FIG. 26D is a perspective view of the lower part of the packaged unerected container as shown in FIG. 26.

Figure 26E:
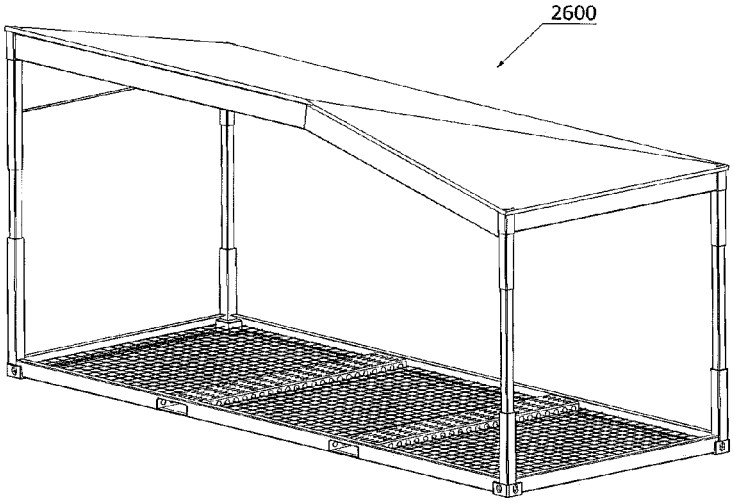

FIG. 26E is a perspective view of the container as shown in FIG. 26 in an erected state.

Figure 26F:
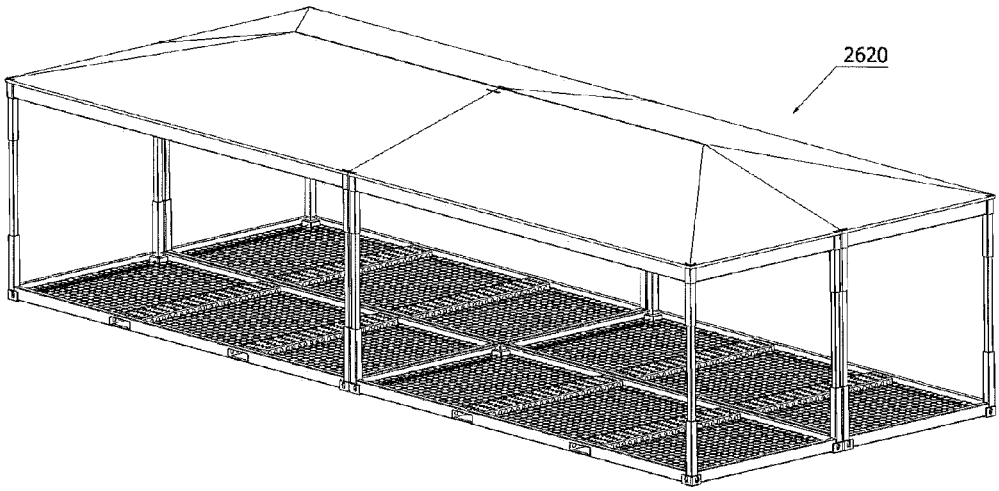

FIG. 26F is a perspective view of an assembled building.

Figure 26G:
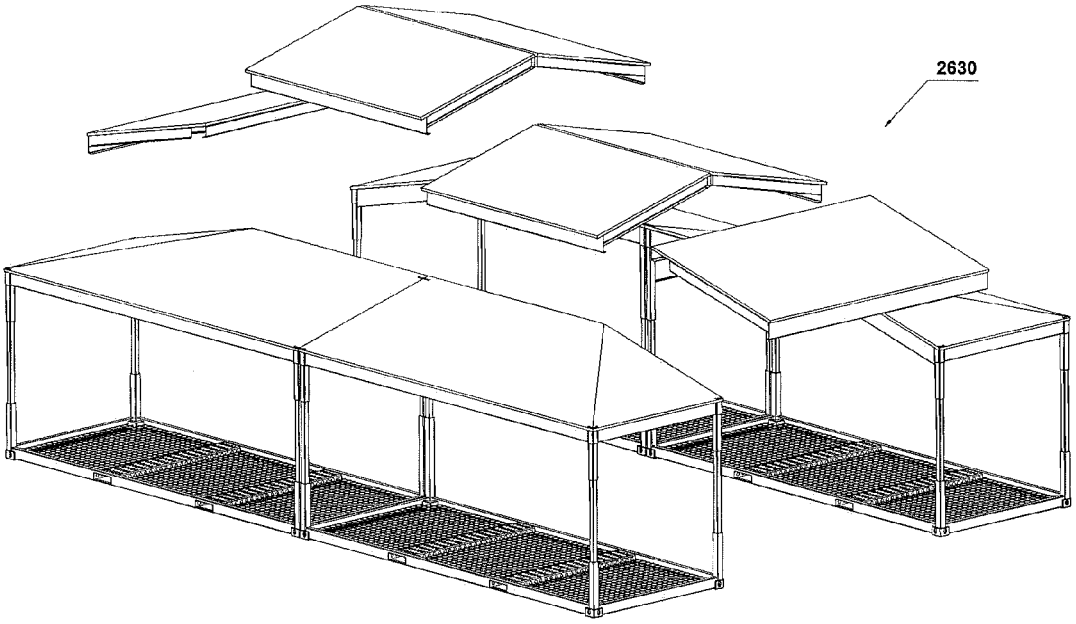

FIG. 26G is a perspective exploded view of another partially assembled building.

Figure 26H:
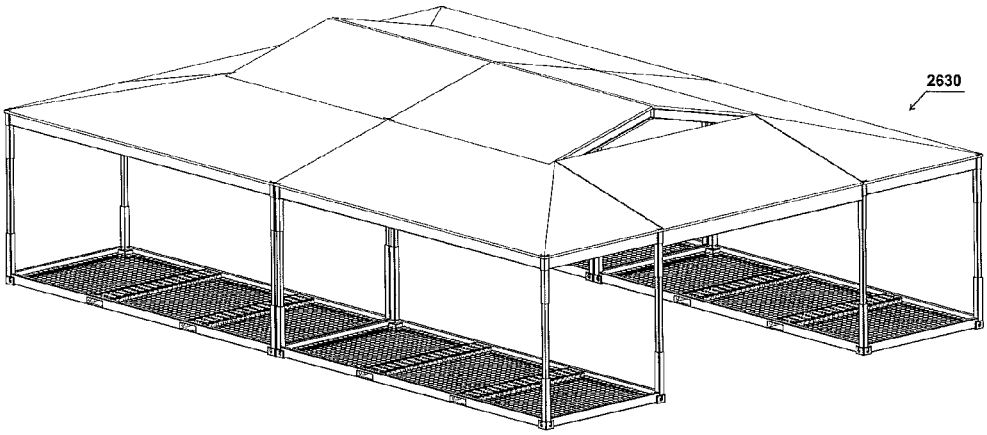

FIG. 26H is a perspective view of a fully assembled building as shown in FIG. 26G.

Figure 27:
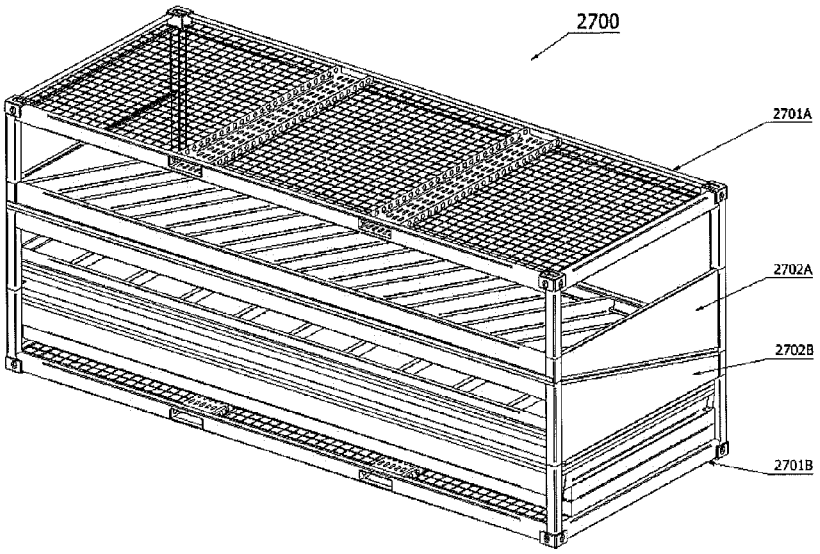

FIG. 27 is a perspective view of a container in kit form.

Figure 27A:
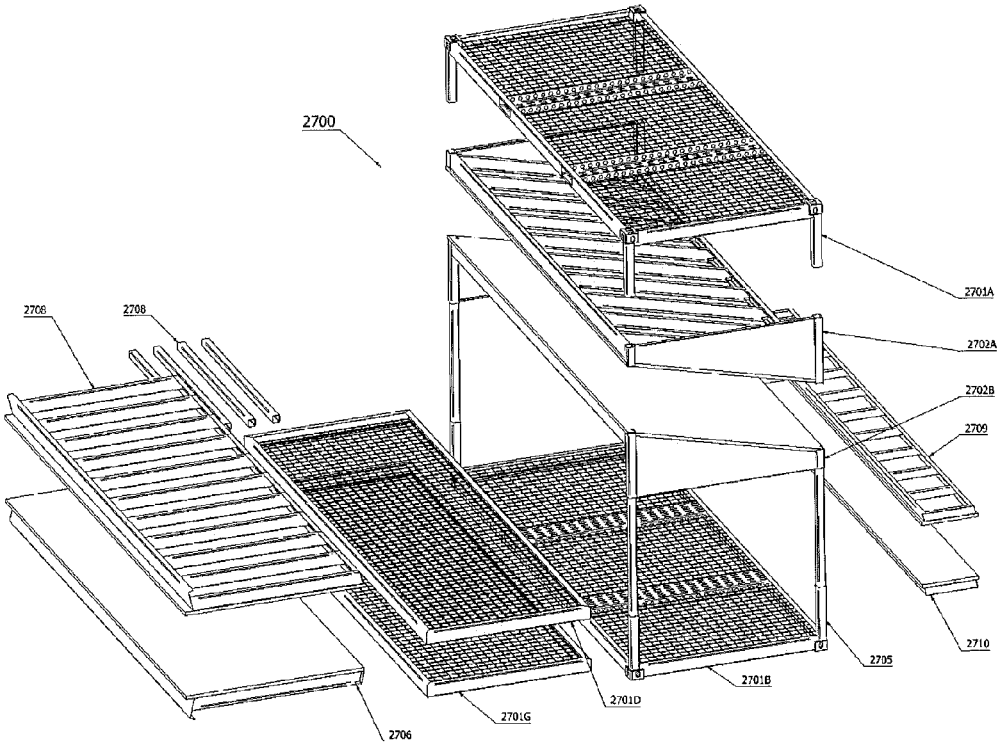

FIG. 27A is an exploded view of the container as shown in FIG. 27.

Figure 28:
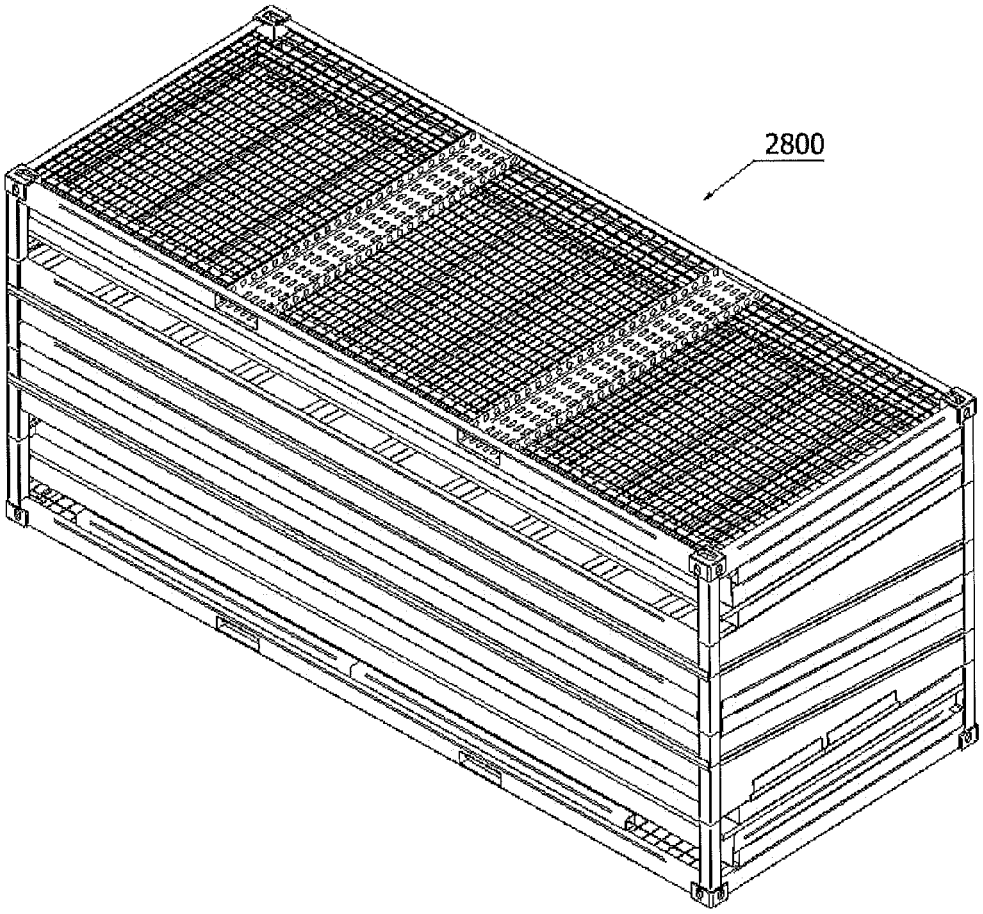

FIG. 28 is a perspective view of a container in layered schematic form.

Figure 28A:
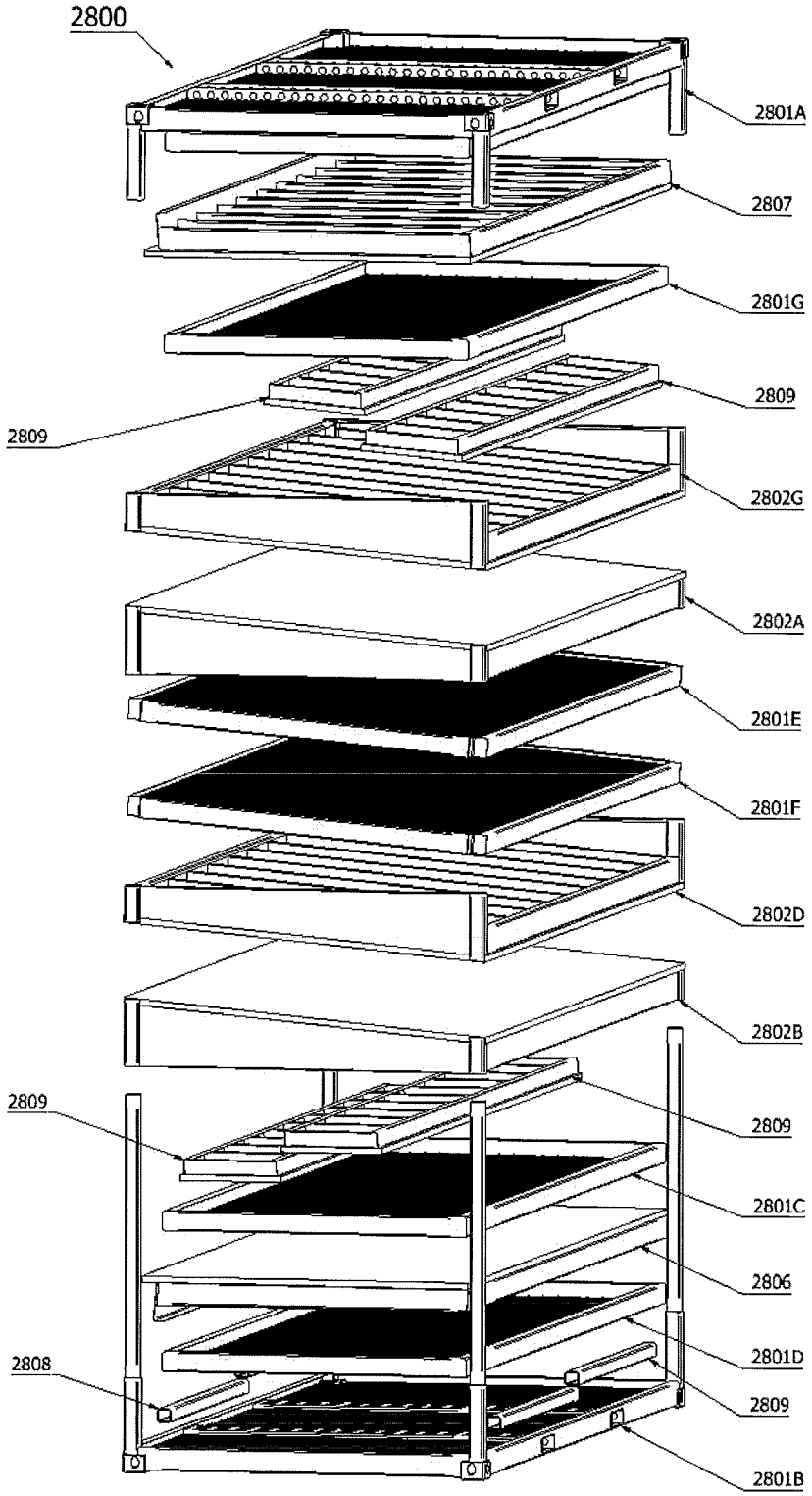

FIG. 28A is an exploded view of the container as shown in FIG. 28.

DESCRIPTION OF THE PREFERRED EMBODIMENT(S)

The following description will describe the invention in relation to preferred embodiments of the invention, namely a height adjustable shipping container The invention is in no way limited to these preferred embodiments as they are purely to exemplify the invention only and that possible variations and modifications would be readily apparent without departing from the scope of the invention.

The inventive construction system is applicable for use as residential housing, domestic garages, machinery & farm sheds, emergency accommodation, etc.

The invention relates to a new system for the construction and transportation of accommodation that has many benefits compared to existing systems. The proposed system possesses a significant reduction in the net cost of production, and it addresses and resolves issues in the systems currently available.

Generally the invention pertains to an external building shell that is delivered and erected in minimum time, which may be as little as a few hours in some construction cases (eg: garages). As the building shell is fully enclosed, there are no weather limitations on the construction timeline. Local tradesmen may be engaged to do the internal installations thus promoting the local construction industry and stimulating the local economy, which is desired by councils and governments. The highly skilled local workers are likely to be more efficient than low-skilled, cheaper workers from foreign economies, and as weather conditions would not be a factor, these local workers would be more able to work with optimum efficiency and remain economically competitive compared to the global market. The inventive system is formatted around the ISO shipping container design, and is easily transported and positioned using equipment that is readily available. Due to the simplicity of the on-site setup of the building shell, for uncomplicated projects a low skill set is necessary to complete the required assembly. The finished erected building meets international bush fire building regulations.

In emergency accommodation situations, the ease of building erection and fully enclosed nature of the system mean that homeless people can have immediate shelter and security. In the collapsed container state, the inventive system can also be used to transport and store emergency relief materials, such as food and building resources, within the collapsed container.

Due to the versatility of the inventive system, including the potential to connect many individual containers together, it is possible to quickly create a large, sheltered and secure space that can be used for a variety of purposes, such as a hospital, a food storage facility, or for occupancy by many families. This latter use could also promote a sense of community living, helping to provide comfort to people affected by disasters.

The side panels that are used as bracing when the building unit is being transported can be relocated to the outer shell of the erected frame to create a combination of external walls, windows and door openings. The panels, windows and doors are interchangeable, and able to create a large number of different formats as desired.

Turning now to the drawings that exemplify the invention.

Figure 1:
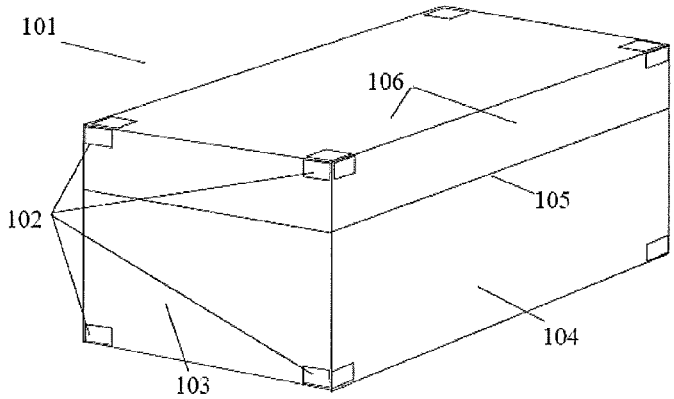
FIG. 1 is a height adjustable shipping container in accordance with a first preferred embodiment of the invention.

FIG. 1 shows a height adjustable shipping container 101 in which vertical corner rails extend to trucking and lifting points 102 at each end. Vertical walls on the exterior extend to cut line 105 forming partial end panel 103, partial side panel 104 and top panel and top side partial panels 106.

Figure 2:
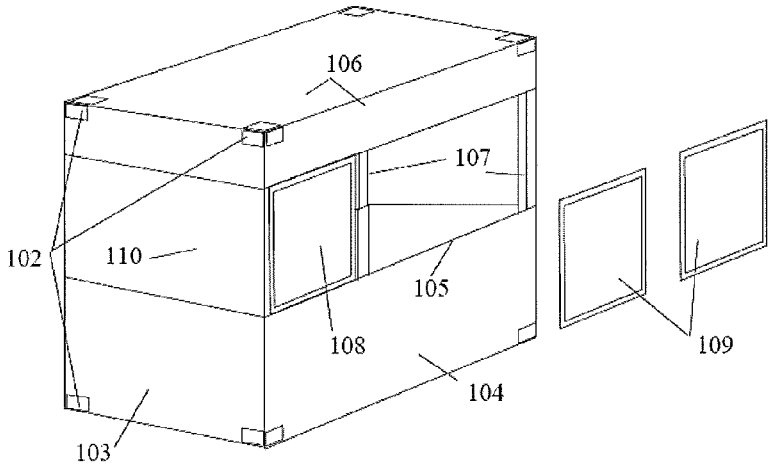
FIG. 2 is the container of FIG. 1 in an expanded position.

FIG. 2 shows the container of FIG. 1 in expanded form in which telescoping rails 107 have been expanded, a panel 110 formerly behind panel 103 has been pulled up into place and a window 108 formerly packed inside the container with windows 109 has been placed in the gap formed by expansion. Other panels or equipment which may have been packed within the container, such as doors, roller doors, ventilators, tables, etc can be fitted to the expanded container. Still others may be permanently fitted to the container before dispatch, such as lighting or plumbed fitments.

Figure 3:
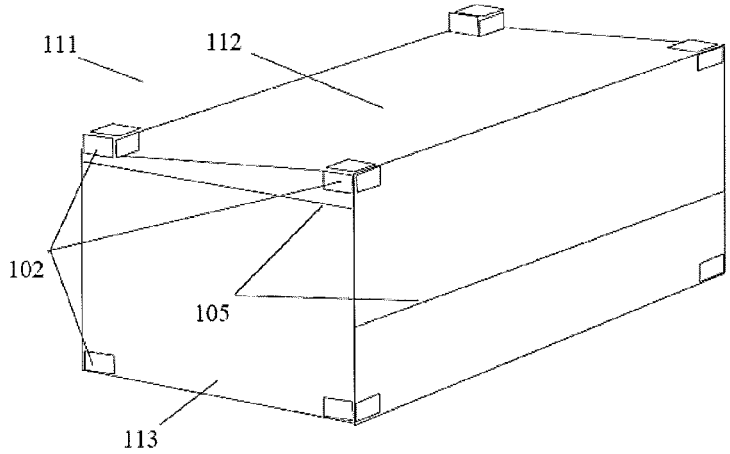
FIG. 3 is a variation of the container of FIG. 1.
Figure 4:
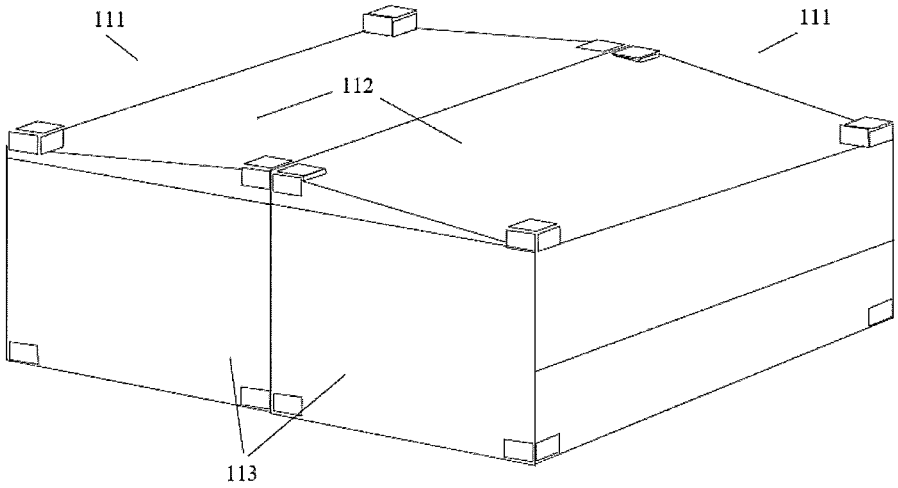
FIG. 4 is an assemblage of two containers as shown in FIG. 3.

FIG. 3 shows a container 111 with a tilted top forming part of a peaked pitched roof 112 and an end panel 113. Cut lines 105 are offset, providing for different panel fitments at each cut. Typically any services required in the container (plumbing, electrical) are located adjacent a joint line to allow easy servicing and testing on installation. FIG. 4 shows two containers such as that of FIG. 3 butted together before being expanded into a single larger accommodation structure. Various of the walls may be shifted in position when expanded, so that for instance the end panels 113 may be relocated to fill the other end leaving one end open for access.

In an alternative the two containers may be spaced apart and parts for bridging the gap between may be packed with the containers. This may include, for instance, flooring and a roof ventilation bridge.

Figure 5:
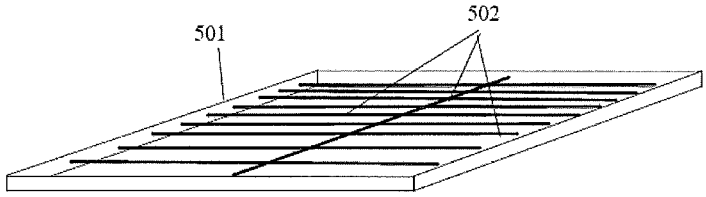
FIG. 5 is a prefabricated floor assembly suitable for a container.

FIG. 5 shows a view of a floor pan for a container which is intended to be static. It consists of an edge structure 501 and reinforcing bars 502 to allow the pouring of concrete or some other settable pourable material into the pan at the final site, producing a reinforced concrete pad within the container.

Figure 6:
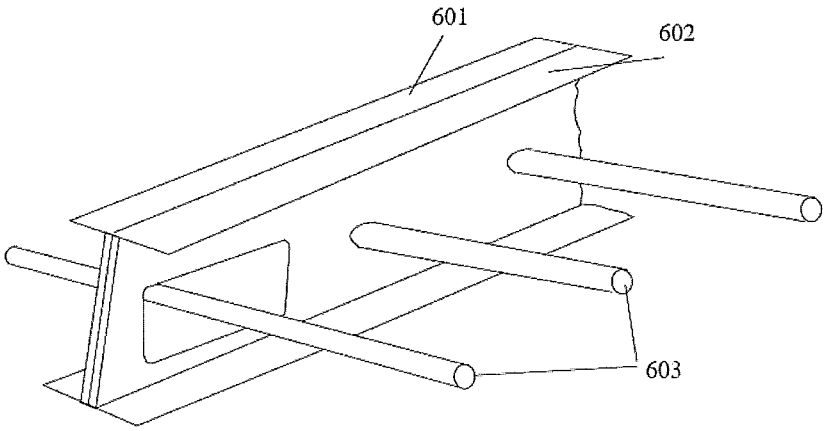
FIG. 6 is detail of a joint between two prefabricated floor assemblies of FIG. 3.

FIG. 6 displays a method of carrying the reinforcing 603 through containers abutted and secured together as in FIG. 4 so that edge rails 601, 602 are adjacent to render the concrete pad continuous.

Figure 7:
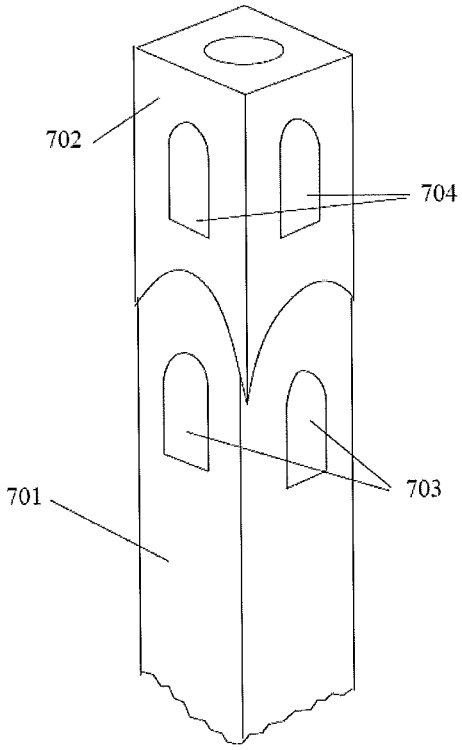
FIG. 7 is a detail of a telescoping expanding vertical container rail.

FIG. 7 shows a view of a telescoping pole in expanded form. A lower portion 701 with engagement feature 703 for trucking or lifting has a cap 702 which slides down over portion 701. When slid down the engagement features 704 align with those at 703 to allow lifting the compacted container.

Figure 8:
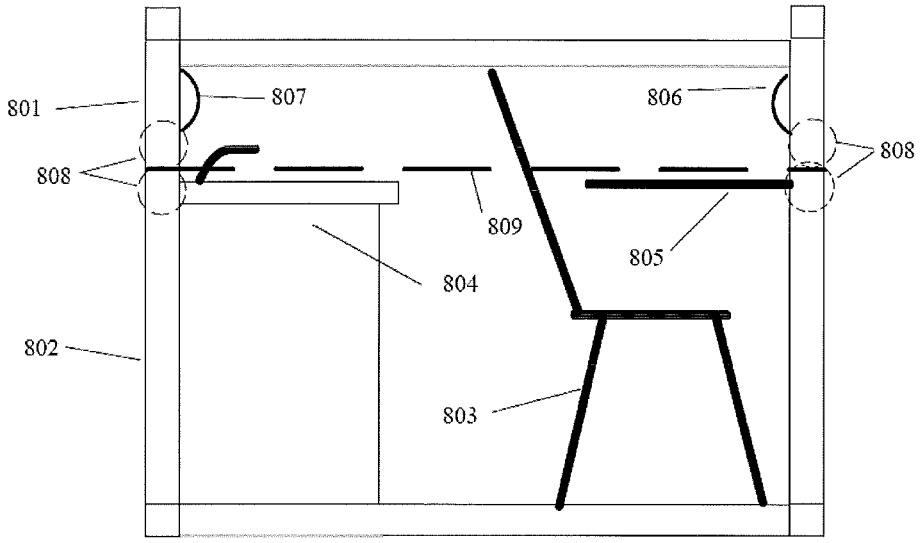
FIG. 8 is a side view of a section of a compacted accommodation container.

FIG. 8 shows a side view of the interior of an accommodation container. External panels 801, 802 have a cut line between them allowing compacting of the container onto chair 803, sink and faucet 804, desk 805 and lights 806, 807. Plumbing, electricity and any other utility services for the lights, wall power and sink may be located in areas 808 at the junctures of the cut line, providing access to services before the container is collapsed and after it is expanded. These services may be located within channels at the top of bottom of a wall attached to the container structure.

The cut line for such accommodation is preferably at 900 mm above the floor with panel 801 being 300 mm high to give a compacted height for the container of 1200 mm compared to the full standard height of 2500 mm or 2900 mm. This means that normal furniture can be accommodated within the compacted container.

Figure 9:
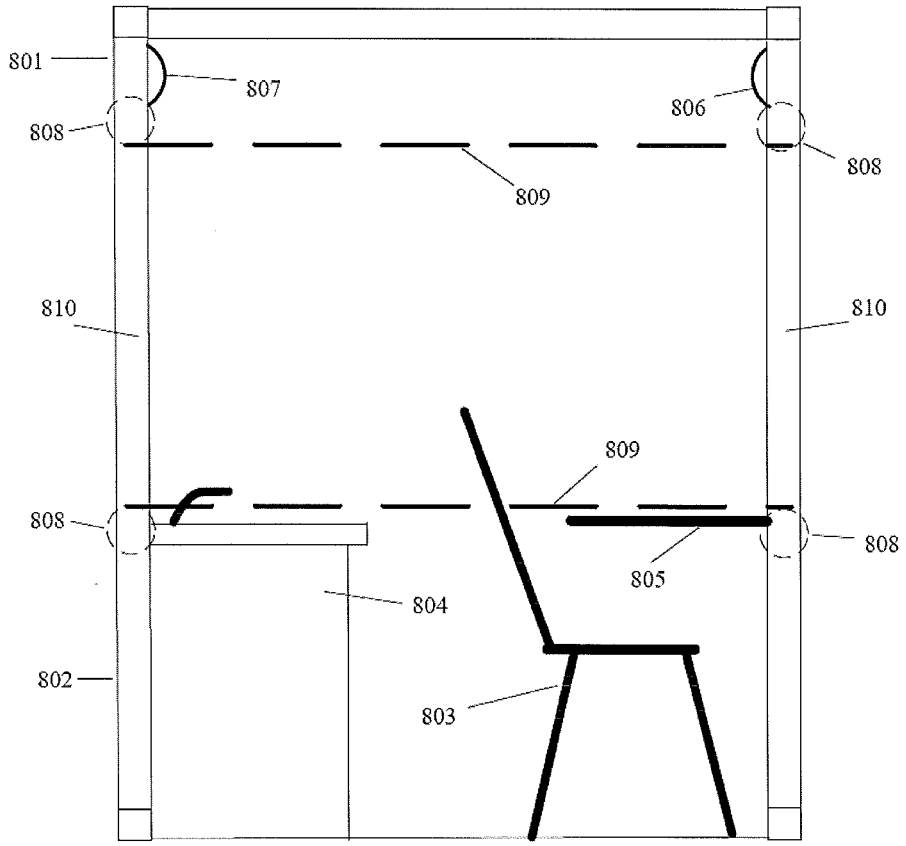
FIG. 9 is a side view of the container of FIG. 8 in expanded form.

FIG. 9 shows the same container in expanded form with the cut lines spaced apart by panels 810. Before panels 810 are finally placed the services are connected, for instance by cables from lights 806, 807 being connected to a central connection board within areas 808 by sockets or by connector block. This has the advantage that access is relatively easy while the container is being expanded on site.

It is important that the compacted container still adheres to the measurements of a standard shipping container which means that in some cases a collapsed telescoping pole will still stand above part of the structure of a containerised building, as in FIG. 3.

Figure 10:
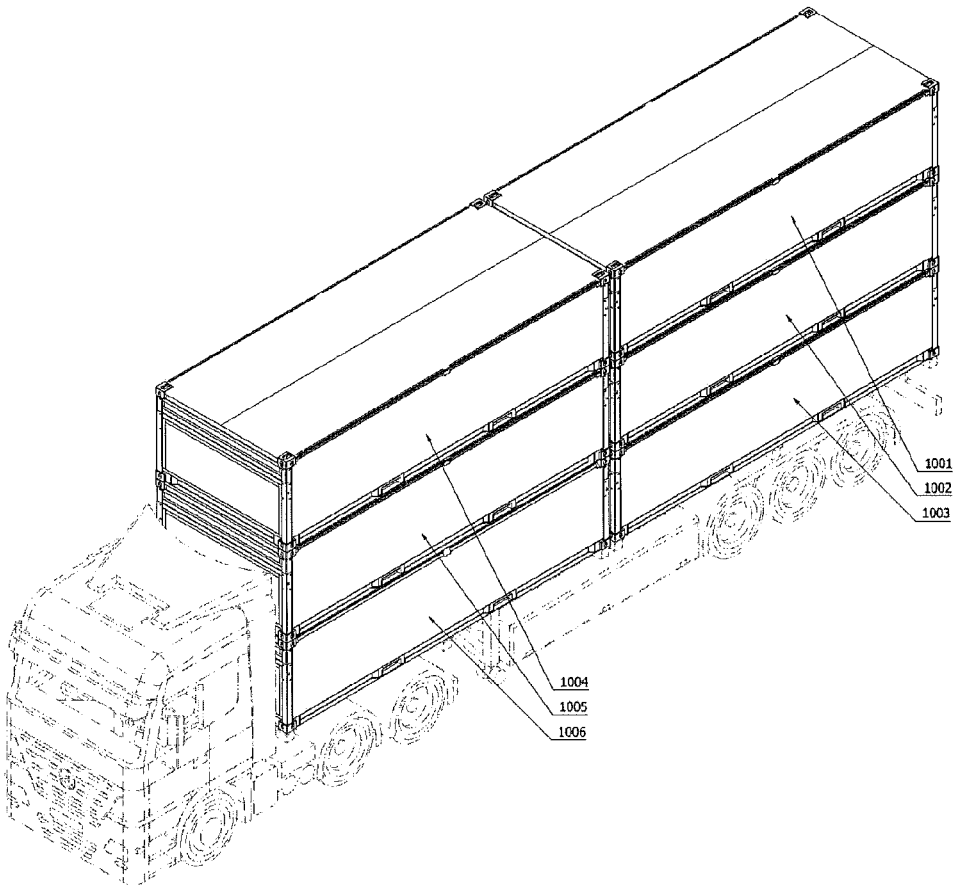
FIG. 10 is a perspective view of collapsed containers situated on a truck trailer ready for transport in accordance with a second preferred embodiment of the invention.

FIG. 10 shows a truck transporting the shipping containers of the invention. Each container 1001 to 1006 is of a collapsed and reduced size or height relative to a standard shipping container. Each shipping container 1001 to 1006 includes all the components, including framing, walls, panels, etc., required to erect a building structure such as for mining, accommodation and/or commercial purposes.

Figure 11:
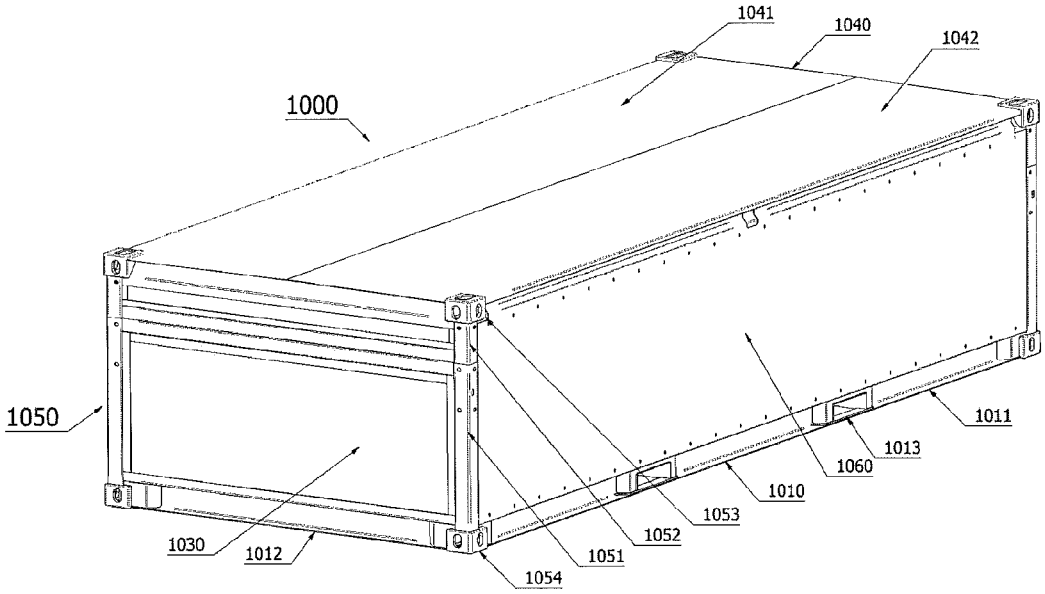
FIG. 11 is a perspective view of one of the collapsed containers shown in FIG. 10.

FIG. 11 shows a shipping container 1000 in its storage and transportation state. The container has a chassis 1010 with side beam 1011 and end beam 1012. Side beam 1011 has at least two spaced apart fork lifting pocket openings 1013. The side and end beams 1011, 1012 connect with lower standard ISO corner element 1054 at the base of column 1050. The column 1050 includes a lower section interleave guide part 1051 and an upper section interleave guide part 1052 where the upper section interleave guide part 1052 telescopes within the lower section interleave guide part 1051 such that the height of the container 1000 can be adjusted in order to form a building structure when transported to the desired location. The container 1000 has side walls 1060, end walls 1030 and roof 1040. The column 1050 has an upper standard ISO corner element 1053.

Figure 13:
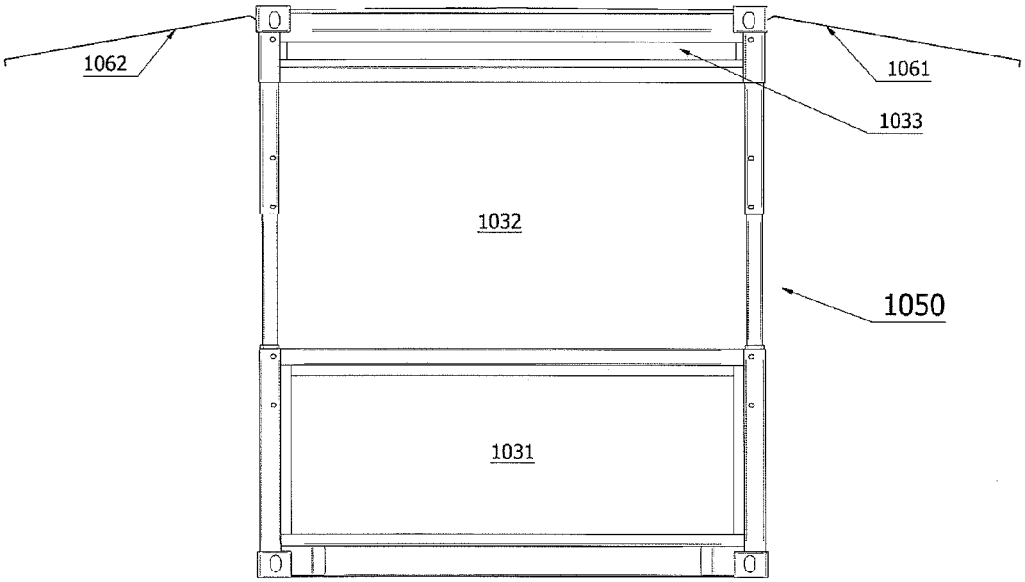
FIG. 13 is an end view of the container shown in FIG. 12.

FIGS. 12 and 13 show the container 1000 in an erected state in which the columns 1050 are fully extended. The erected container is shown with end wall panels 1031, 1032, side wall panels 1062, 1063, 1064, 1065, 1067, 1068 and door 1066, 1082. End wall panel 1031 and side wall panels 1063, 1064 are fixed in place whereas end wall panel 1032 and side wall panels 1065, 1065, 1067 & 1068 are removable. Side panels 1061, 1062 open out to form eaves, awning or shade panels and can be connected to another adjacent container to form a shelter walkway/porch area.

Figure 14:
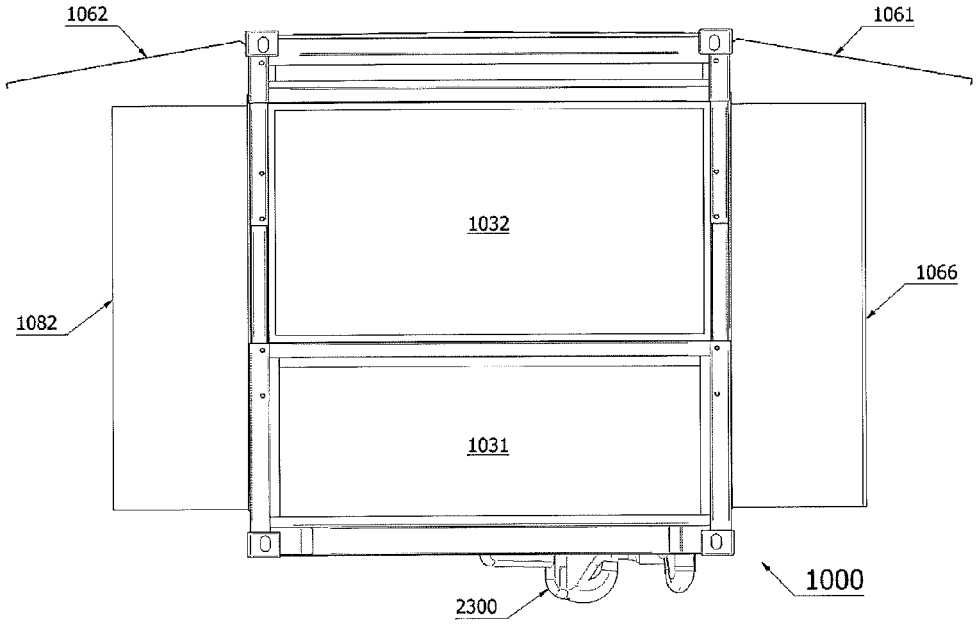
FIG. 14 is a further alternate end view of the container shown in FIG. 12.

FIG. 14 shows a variation to the container 1000 shown in FIG. 13 in that FIG. 14 includes a plumbing drainage component 2300 beneath the floor of an assembled and erected container 1000. Preferably the plumbing draining 2300 is transported within the container and connected in place once the container is sited and erected in the desired place.

Figure 15:
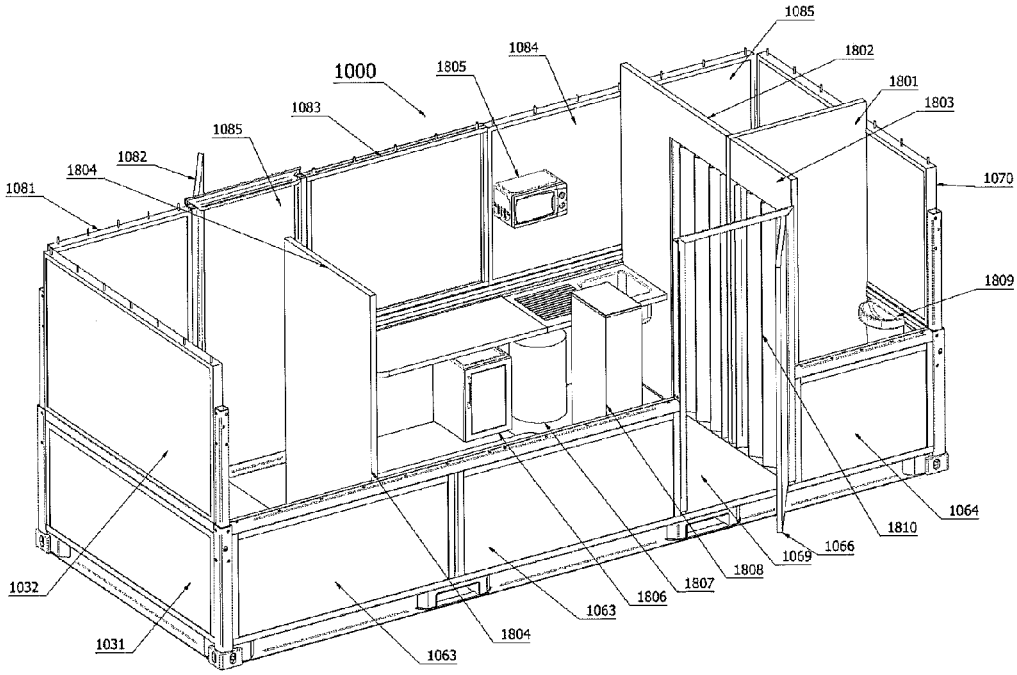
FIG. 15 is a perspective cut-away view of the container shown in FIG. 12.
Figure 16:
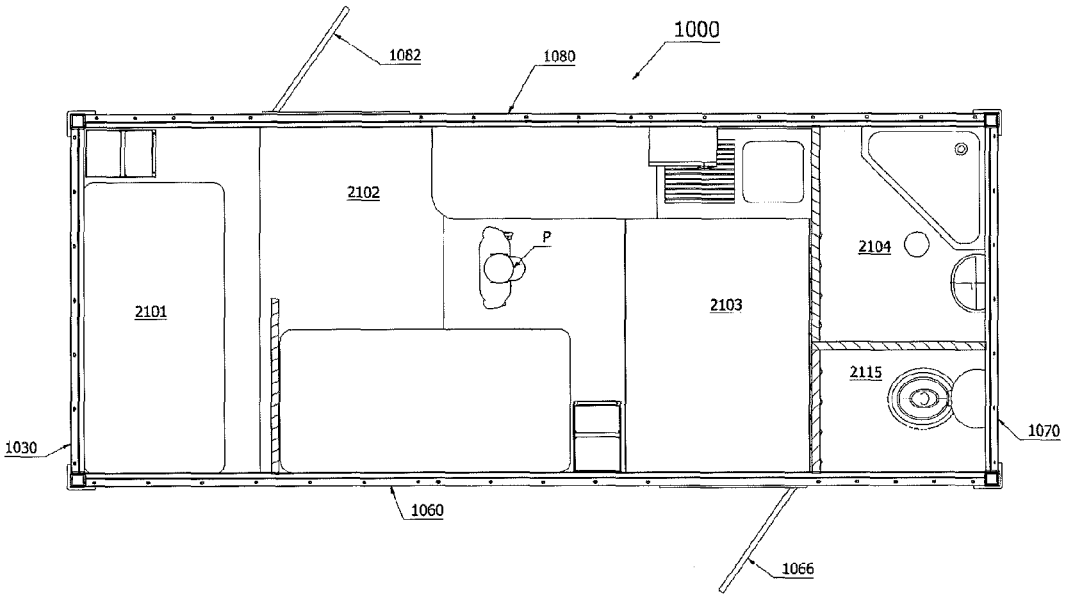
FIG. 16 is a top view of the container shown in FIG. 15.

FIGS. 15 and 16 show a cutaway view of an assembled and completed container 1000. The container 1000 is shown to include a bedroom 2101, lounge area 2102, kitchen area 2103, bathroom 2104 and toilet 2115. Preferred fittings, appliances and amenities shown are microwave 1805, fridge 1806, hot water tank 1807, locker 1808 and water closet 1809. It is envisaged that other fittings, appliances and amenities can be utilised to suit the purpose to which the erected and completed container is to be used for.

Figure 17:
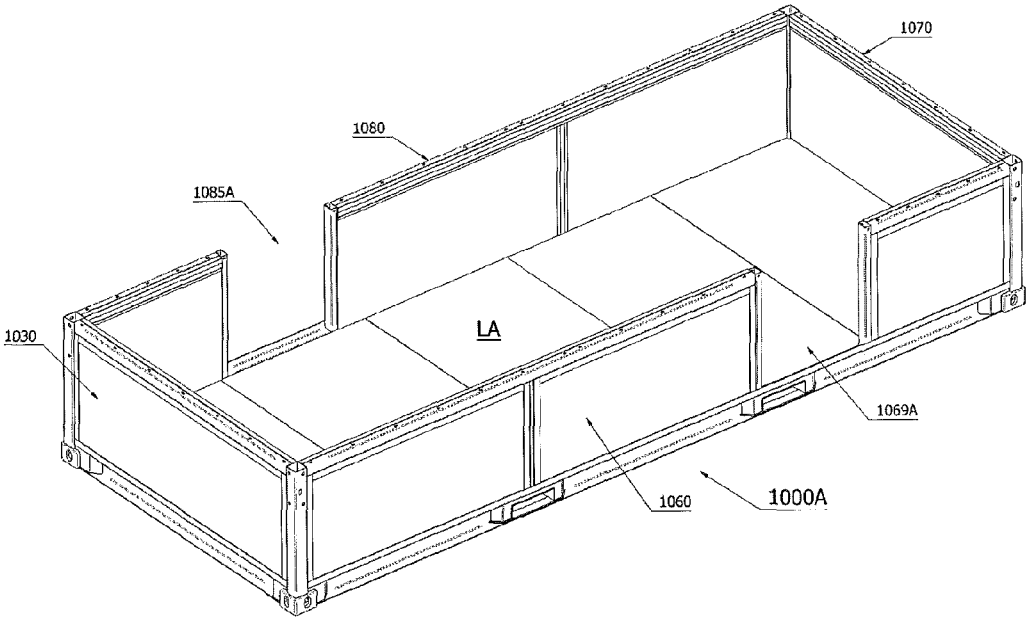
FIG. 17 is a perspective view of the lower frame of the container shown in FIG. 12.
Figure 18:
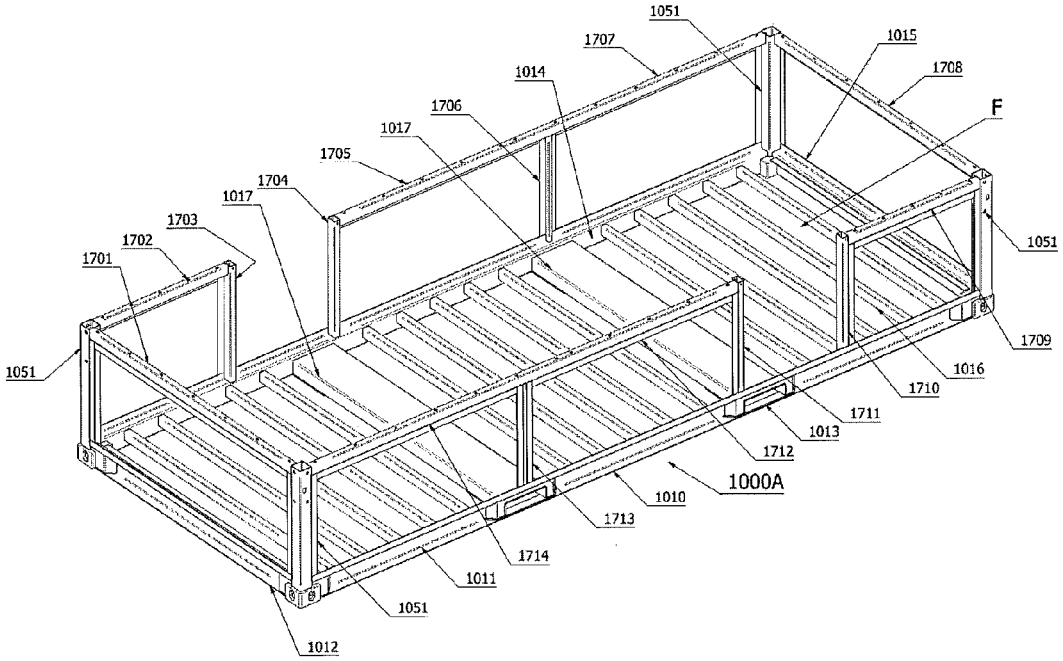
FIG. 18 is a perspective view of the lower frame shown in FIG. 17 without side panels and floor.

FIGS. 17 and 18 show the lower frame 1000A of the container. FIG. 17 shows the lower frame in an assembled state with floor LA, side panels, and end panels in place. The end walls 1030, 1070 consist of end beams 1012, 1015 and structural service duct supports 1701, 1708 connected to and spaced apart by lower section interleave guide columns 1051. The side walls 1060, 1080 include side beams 1011, 1014 connected to the lower part of lower section interleave guide columns 1051. The structural service duct supports 1702, 1705, 1707, 1709, 1712, 1714 are spaced respectively above the side beams 1011, 1014 by the combination of the lower section interleave guide columns 1051 and vertically extending door posts 1703, 1704 and structural service duct supports 1706, 1710, 1711, 1713 to form sub frames to define walls for panels and windows and openings 1069A, 1085A for doors. The upper structural service duct supports, 1701, 1702, 1705, 1707, 1708, 1709, 1712, 1714 can include slotted holes in which windows and wall panels can be inserted and held in place without the need to use fasteners or the like to hold windows and panels in place.

Figure 19:
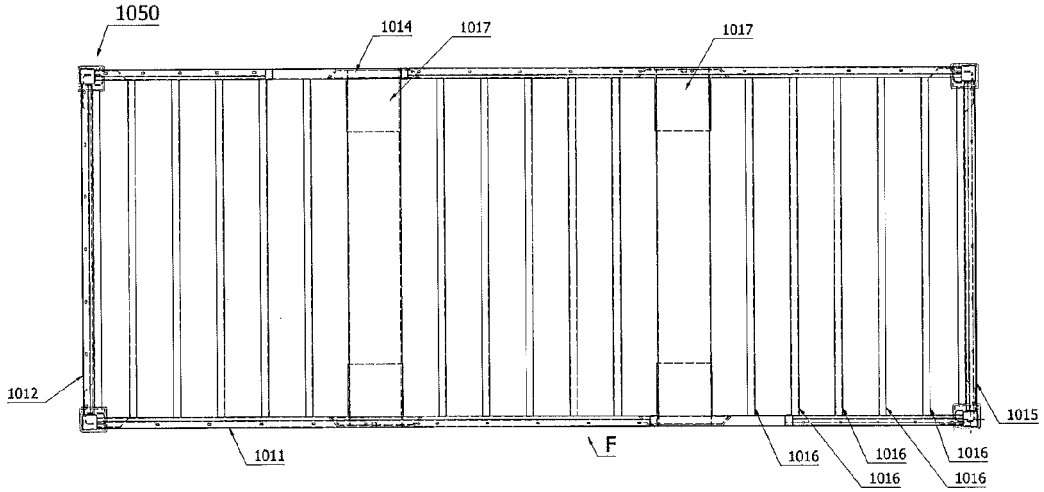
FIG. 19 is a top view of the lower frame shown in FIG. 18.

FIG. 19 shows the floor F of the container. The floor consists of a frame including side beams 1011, 1014 and end beams 1012, 1015 that are connected at the ends to the base of columns 1050. At spaced intervals between side beams 1011, 1014 are connected floor joists 1016. Situated equally spaced apart from the centre of the floor frame are fork lifting support compression plates 1017 that are hollow to accommodate the forks of a fork lift. The floor F as shown in FIG. 19 is included in the unerected container and is assembled and erected onto ground or piles or the like at the desired location upon which the container is then lowered and erected thereto. A pourable, settable medium such as cement is then poured (or this can be done prior to the container being put in place) to form a concrete floor.

To construct the floor, reinforcement steel is fixed inside the container and positioned so that concrete or another setting medium can be installed immediately and under cover. The skill requirement for floor construction is low as there is a relatively small distance between the form boards, which are of a uniform height. This allows for easy levelling of the concrete. The cement for the concrete can also be transported within the collapsed container shell. Concrete would also provide a floor capable of being easily decontaminated and cleaned, which is essential for use in hospitals.

Figure 20:
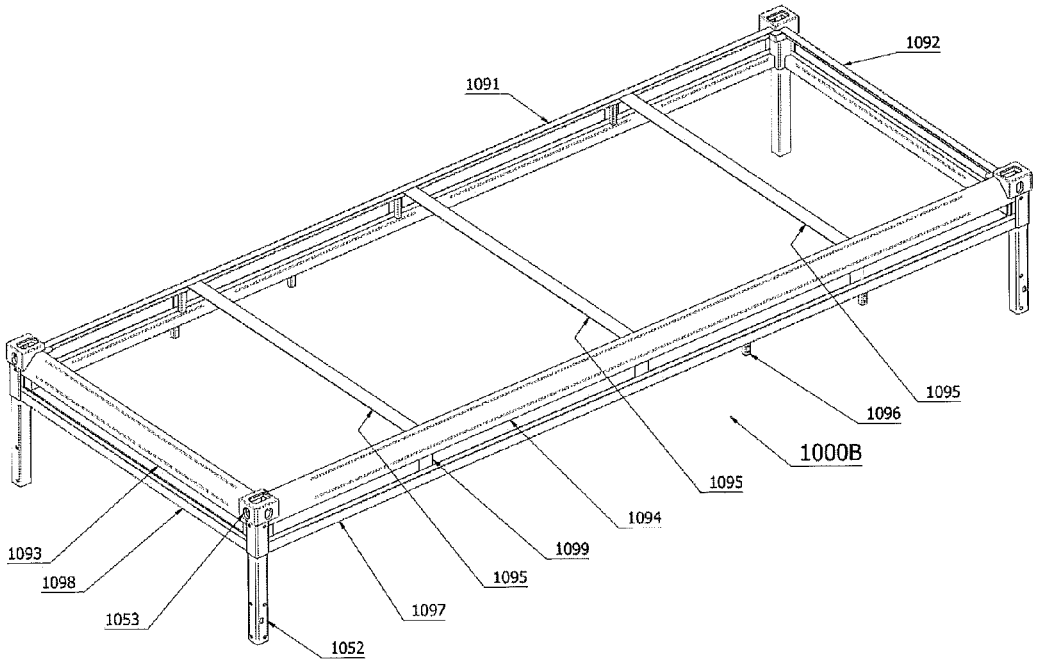
FIG. 20 is a perspective view of the upper frame of the container shown in FIG. 12.

FIG. 20 shows the upper frame 1000B of the shipping container. The upper frame 1000B consists of upper side section structural members 1091, 1094 connected to upper end section structural member 1092, 1093, upper standard ISO corners 1053 of upper section interleave guide columns 1052. Structural service duct supports 1095 are situated spaced apart between the upper side section structural members 1091, 1094 in order to provide structural support. Lower upper side section structural members 1097, 1098 extend spaced below the upper section structural members 1091, 1092, 1093, 1094. Structural service duct supports 1099 extend between the upper side section structural members 1091, 1094 in order to provide further structural integrity to the upper frame 1000B. Depending down from the Lower upper side section structural members 1097, 1098 are door post spigots 1096 situated in position where a door is to be situated and supported there under. The upper frame 1000B can include fork lifting support compression plates (not shown) similar to the compressions plates 1017 in FIG. 19. These compression plates that are hollow accommodate the forks of a fork lift to allow the upper frame to be raised and situated in place when erecting a building structure.

FIGS. 21 and 22 show aspects of the expandable column 1050. The column is attached at its base to the side beam 1011 by standard ISO corner 1054. The column 1050 consists of three telescoping hollow interleave guide columns 1051, 1055 and 1062. Lower section interleave guide column 1051 is connected at its lower end to standard ISO corner. Centre section interleave guide column 1055 is of a smaller diameter to that of both interleave guide columns 1051 and 1052 such that centre section interleave guide column 1055 is able to telescope within interleave guide columns 1051, 1052 such that when the container is in a storage and transport state centre section interleave guide column 1055 is fully enclosed within interleave guide columns 1051, 1052. Upper interleave guide column 1052 is attached to the upper standard ISO corner 1053 and also can be of a smaller diameter to that of lower section interleave guide column 1051 such that in the unerected state part of upper section interleave guide column 1052 fits within lower section interleave guide column 1051.

The standard ISO corners 1053, 1054 include holes 1056, 1057 that are able to act as lifting points so that the interleave guide columns 1052, 1055 can be raised and lowered relative to lower section interleave guide column 1051.

FIG. 23 shows a cross-sectional view of part of an erected container. There is shown a floor F supported on floor joists 1016 fixed to side beam 1010 that supports a lower wall panel 1063, service duct support 1705, upper wall panel/window 1067 that all form part of side wall 1060. Side panel 1061 fastened to side wall 1060 during transport made by fasteners 1716 is used as an awning or extended eave or shutter when and once the container is erected and assembled. Side panel 1061 also acts during transport as a shock absorber and as a brace. A ceiling panel 1720 extends transversely from and connected to, via corner internal coving 1715, the top of wall panel/window 1067 and is situated below roof 1040. An air gap exists between the ceiling panel 1720 and roof 1040 which can be used as part and connected to an air conditioning system.

FIGS. 24 and 24A show a packaged container 2400 ready for transport (minus the side panels), the container 2400 consists of a floor base 2401, roof sections 2402A, further wall/roof sections 2403, 2404 and columns 2405. FIG. 24C shows the container in a fully erected state ready to be fit out and completed. FIG. 24D shows a building structure of an area equally to area of two containers 2400, 2410 joined side by side to the form a building structure. FIGS. 24E & 24F show two assembled containers 2400, 2410 joined together by a covered roof/walkway 2420. Whilst in the lower un raised position such as that shown in FIG. 24E roofing, eaves and other roof and ceiling related components and fittings for ease of assembly and occupational health and safety requirements. FIGS. 24G & 24I shows a building structure 2430 having two levels and equal in area to that of that of eight shipping containers. FIG. 24H shows a building structure 2440 equal in area to that of that of three shipping containers. FIGS. 24J & 24K shows a container 2400 in ready condition and configuration for transportation showing floor base 2401A, 2401B, roof sections 2402A, 2402B, columns 2405 and wall panel sections 2406, 2407, 2408, 2409. It is envisaged that one container includes enough components to build a building structure the equivalent in floor area to that of at least two shipping containers.

FIGS. 25 and 25A show a packaged container 2500 ready for transport (minus the side panels), The container 2500 consists of a floor base 2501A, 2501B, roof sections 2502A, 2502B, further wall/roof sections 2503, 2504 and columns 2505. FIG. 25B shows a partial assembled container 2500 in which the roof section has yet to be raised relative to the base by adjusting the columns 2405. FIG. 25C shows the container 2500 in a fully erected state ready to be fit out and completed. FIG. 25D shows a building structure 2520 formed and equal in area to that of that of eight shipping containers.

FIGS. 26 and 26A show a packaged container 2600 ready for transport (minus the side panels), The container 2600 consists of a floor base 2601, roof sections 2602A, 2602B, further wall/roof sections 2603, 2604 and columns 2605. FIGS. 26B & 26C shows exploded views of the container 2600 in an erected state. FIG. 26D shows a partial assembled container 2600 in which the roof section has yet to be raised relative to the base by adjusting the columns. FIG. 26E shows the container in a fully erected state ready to be fit out and completed. FIG. 26F shows a building structure 2620 formed and equal in area to that of that of four shipping containers. FIGS. 26G & 26H shows a building structure 2630 formed and equal in area to that of that of four shipping containers and has a covered walkway/roof.

FIGS. 27 & 27A show the container 2700 in kit form identifying the key components required to build a building structure of at least equal in area to the floor area of two shipping containers combined. The kit includes floor base 2701A, 2701B, 2701C, 2701D, roof sections 2702A, 2702B, columns 2705, centre roof panels 2706, 2707, extra columns 2708, and eave panels 2709, 2710.

FIGS. 28 & 28A show the container 2800 in a layered schematic form identifying the key components required to build a building structure of at least equal in area to the floor area of two shipping containers combined. The kit includes floor base 2801A, 2801B, 2801C, 2801D, 2801E, 2801F, 2801G, roof sections 2802A, 2802B, 2802C, 2802D, columns 2805, centre roof panels 2806, 2807, extra columns 2808, and eave panels 2809.

The columns may include a horizontal steel channel to support a beam between the columns.

The beam could be of concrete, steel, wood or similar suitable material adapted to bear and support a load such that of an upper floor.

The fork lift pockets can be used for the carriage of services once the floor is concreted The upper and lower frame parts can be delivered together to eliminate sequence confusion that currently exists with known methods.

The unassembled parts can be transported on a frame so that they can be assembled at the point of destination and thus allowing the transportation of a greater floor and roof area High quality external finishes, such as cladding or brickwork, can be installed to create a more traditional appearance. Paint and/or texture patterns, such as roof tiles or bricks, could also be printed into the steel panels. Internal walls can also be easily constructed including insulation, plaster board and paint.

If a wider building is desired, additional infill sections may be installed on the roof and floor, connecting two housing module units on either side.

The building units may be used to rapidly and cheaply construct a double garage.

Multi-storey buildings are envisaged whereby building shells can be erected on top of another. Floor pans can be installed to the concrete sections for the construction of a second-storey concrete (or other medium) floor, which can also be fire rated.

Any existing building format can be replicated. Eaves, valleys, hips and other traditional building features are designed into the system.

Builders can program projects without the weather constraints that currently exist. This would maximise efficiency of labour and capital, and as progress is not limited by adverse weather conditions, it would create more stable cash flows and a more stable and predictable building industry.

In 2011, the prefabricated housing market in America alone produced 185,000 units and was worth US$8-6 billion. This is a big market, and this method will significantly reduce the cost of the building shell, and could potentially revolutionise the industry by supplying more efficient, affordable housing.

The versatility of the construction design enables the inventive system to be used to create a vast variety of buildings for different applications including, but not limited to, residential housing, storage units, sheds, garages, and buildings for emergency relief, public or commercial use.

The new inventive building system has many applications for portable/modular buildings, and a major use for such buildings is in mining camp accommodation.

The modular building industry is less than five years old and has undergone many developments that have led to greater efficiencies over this time. However there is a need for even more efficient and serviceable products. The new and inventive system for the construction and transportation of portable housing accommodation has many benefits and improvements compared to existing systems. The proposed inventive system possesses a significant reduction in the net cost of production, and it resolves issues in the systems currently available.

The product requires minimal on-site setup, with fully complete interior fittings and services.

The collapsed building shell simply needs to be placed, erected and centre panels inserted, which takes minimal time The inventive system allows for the access of all services with ease, and allows for upgrading, testing and repair if required at any time.

The inventive system addresses occupational health and safety issues and reduces the risk of personnel injury during construction. As it has been fully designed considering safety.

The inventive system is formatted around the ISO shipping container and is easily transported and positioned using readily available equipment.

The storage space required is reduced by 50%, so transportation costs are also reduced by up to 50% or more, which is a considerable cost advantage. Furthermore, twice as many units can then be delivered in the same amount of time.

The manufacturing process has been designed so that different components may be constructed at different sites, and services can be installed depending on the local government standards, e.g. wiring colours, plumbing, etc. Installation of services and amenities would occur at the final assembly stage.

Covered walkways and balconies can be included in the design.

The inventive system can be used for mining and military accommodation, and emergency relief, and it is light enough that it could be air dropped from a cargo plane As the fuel and transport costs are greatly reduced, the inventive system is 'greener' than current systems and would be eligible for carbon credits The inventive system has been designed to be mass produced using a similar method as is used in the automobile industry.

It is estimated that over the next 5 years, accommodation will be needed for millions of mine workers.

The location of service ducts horizontally are at the level that services are required i.e. at bench height 900 mm approx and then a 1150 mm approx spacing panel and then another service duct for lighting and then a top panel above to the ceiling junction. The roof section is situated in place last and thus capturing the panels in position and then fastening the roof section to the columns for transport.

As the inventive system allows for more than one building shell to be transported multiple and individual building sections can be coupled together to create a wider building structure.

The finished building structure can have a sloping roof that would be more aesthetically pleasing and allow water or snow to run off the roof and also create a void between the ceiling and roof for ventilation and a more efficient insulation roof area.

The inventive system can utilise spreader pieces to the roof and floor and thus increase the overall width of a completed building where two or more building shells are to be joined together to form a single building structure.

By enclosing the external faces of the transported container sections with protection panels that can be relocated to complete the external walls, the protection panels serve the purpose as a bracing component and a shock absorber to absorb destructive energy during transport caused by pot holes or bumps in road surfaces and other unknown factors during transport. These panels could be installed in such a way to allow window and door openings. This provides an exterior shell of a building that could then be completed in a conventional manner. A concrete floor slab as the base gives the building mass to hold the building down. A concrete slab can be added to the top of the container when used in a high rise situation.

The columns can also be filled with concrete or other suitable material from the top. Reinforcement material such as steel rods can also be installed inside the columns. Thus the finished building will have the sufficient structural integrity and fire rating capacity.

The inventive system generally comes with a horizontal roof which is easier to store, transport and install and can be stacked to many levels if required The inventive system can be transported 2, 3 or more high on a truck or carriage in a near complete state (see FIG. 10)

The inventive system can be pre certified and easily adapted to suit all regions world wide The inventive system requires minimal on-site setup, with fully completed interior fittings and services. The inventive system simply needs to be placed, erected and centre panels inserted reducing commissioning times and reducing costs.

The inventive system allows for easy access of all services, and allows for upgrading, testing and repair if required at any time.

The manufacturing process has been designed so that different components may be constructed at different sites, and services can be installed depending on the local government standards, eg: wiring colours, plumbing, etc. installation of services and amenities would occur at the final assembly stage.

Covered walkways and balconies can be included in the design by utilizing the side panels.

The product can be used for mining and military accommodation, and emergency relief, and it is light enough that it could be air dropped from a cargo plane The inventive system has been designed to be mass produced using a similar method as is used in the automobile industry. There is nothing of this kind on the market.

Eave overhangs, valley panels and other sections that may be required can be installed to the building.

DRAWINGS NUMBER DESCRIPTION LIST

1000 Container
1000A Lower Section
1000B Upper Section
1001 Collapsed Container—Transport Arrangement
1002 Collapsed Container—Transport Arrangement
1003 Collapsed Container—Transport Arrangement
1004 Collapsed Container—Transport Arrangement
1005 Collapsed Container—Transport Arrangement
1006 Collapsed Container—Transport Arrangement
1010 Chassis
1011 Lower Section—Side Beam
1012 Lower Section—End Beam
1013 Fork Lift Pocket Opening
1014 Lower Section—Side Beam
1015 Lower Section—End Beam
1016 Floor Joist
1017 Fork Lift Pockets*Compensation Plate
1030 End Wall
1031 End Wall Panel—Lower Fixed
1032 End Wall Panel—Removable
1033 Side Wall Panel—Upper (Fixed)
1040 Roof
1040 Roof Skin
1042 Roof Skin
1050 Rail/Column
1051 Interleave Guide Rail/Column—Lower Section
1052 Interleave Guide Rail/Column—Upper Section
1053 Standard ISO Corner
1054 Standard ISO Corner
1055 Interleave Guide Rail—Centre Section
1056 Standard ISO Corner Top Opening
1057 Standard ISO Corner Side Opening
1060 Side Wall
1061 Side Panel/Awning
1062 Side Panel/Awning
1063 Side Wall Panel Fixed—Insulated (Sandwich Panel)
1064 Side Wall Panel Fixed—Insulated (Sandwich Panel)
1065 Side Wall Panel Removable—Insulated (Sandwich Panel)
1066 Door
1067 Side Window—Removable
1068 Side Wall Panel Removable—Insulated (Sandwich Panel)
1069 Doorway
1069A Doorway
1070 End Wall
1080 Side Wall
1081 Side Wall Panel Removable—Insulated (Sandwich Panel)
1082 Door
1083 Side Wall Panel Removable—Insulated (Sandwich Panel)
1084 Side Wall Panel Removable—Insulated (Sandwich Panel)

1085 Doorway
1085A Doorway
1091 Upper Side Section Structural Corner Member
1092 Upper End Section Structural Corner Member
1093 Upper End Section Structural Corner Member
1094 Upper Side Section Structural Corner Member
1095 Structural Service Duct Support
1096 Door Post Spigot
1097 Structural Service Duct
1098 Structural Service Duct
1099 Structural Service Duct
1600 Interleave Guide Rail—Collapsed—Section
1660 Interleave Guide Rail—Collapsed—Section
1701 Structural Service Duct
1702 Structural Service Duct
1703 Door Post
1704 Door Post
1705 Structural Service Duct Support
1706 Structural Service Duct Support
1707 Structural Service Duct Support
1708 Structural Service Duct Support
1709 Structural Service Duct Support
1710 Door Post
1711 Door Post
1712 Structural Service Duct Support
1713 Structural Service Duct Support
1714 Structural Service Duct Support
1715 Internal Coving
1716 Fastener
1720 Ceiling Panel
1801 Internal Wall Panel—Removable
1802 Internal Wall Panel—Removable
1803 Internal Wall Panel—Removable
1804 Internal Wall Panel—Removable
1805 Microwave
1806 Fridge
1807 Hot Water Tank
1808 Locker
1809 Water Closet
1810 Flexible Doors
2101 Bedroom
2102 Lounge
2103 Kitchen
2104 Bathroom
2115 Toilet
2300 Plumbing/Drainage
2400 Container
2401 Floor base
2402A Roof section
2402B Roof section
2403 Wall/roof sections
2404 Wall/roof sections
2405 Column
2406 Wall panel
2407 Wall Panel
2408 Wall Panel
2409 Wall Panel
2410 Container
2411 Floor base
2420 Walkway/roof
2430 Two storey building structure
2440 Container building structure
2500 Container
2501A Floor base
2501B Floor base
2502A Roof section
2502B Roof section
2503 Wall/roof sections
2504 Wall/roof sections
2505 Column
2520 Building structure
2600 Container
2601 Floor base
2602A Roof section
2602B Roof section
2603 Wall/roof sections
2604 Wall/roof sections
2605 Column
2620 Container building structure
2630 Container building structure with covered walkway
2701A Floor base
2701B Floor base
2701D Floor base
2701G Floor base
2702A Roof section
2702B Roof section
2705 Columns
2706 Centre roof panel
2707 Centre roof panel
2708 Extra columns
2709 Eave panel
2710 Eave panel
2801A Floor base
2801B Floor base
2801C Floor base
2801D Floor base
2801E Floor base
2801F Floor base
2801G Floor base
2802A Roof section
2802B Roof section
2802C Roof section
2802D Roof section
2805 Columns
2806 Centre roof panel
2807 Centre roof panel
2808 Extra columns
2809 Eave panels

ADVANTAGES a) A height adjustable shipping container is provided which allows a compacted building to be easily transported and expanded at the destination.
b) Multiple containers can be located together to provide rooms which are larger than a single container.
c) Exterior panels of the container may either be packed within the container or moved from one position when compacted to another when expanded.
d) Significant reduction in the net cost of providing accommodation.
e) Formatted around ISO shipping container design.
f) Able to create high rise by stacking multiple containers on one another.
g) Able to be used for different applications including, but not limited to, residential housing, storage units, sheds, garages, and buildings for emergency relief, public or commercial use.
h) The storage space required is reduced by at least 50%, so transportation costs are also reduced by up to 50%.
i) Twice as many containers can then be delivered in the same amount of time.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is hereinbefore described.

The invention claimed is:

1. A method of manufacturing a transportable expandable shipping container for use as a building structure, wherein the transportable expandable shipping container during transportation houses within a minimum of two roofs and two floors such that when the transportable expandable shipping container is expanded for use as a building structure the transportable expandable shipping container makes up a minimum area of that of two standard shipping containers, the method includes:

providing a container base and vertical members, providing at least one first vertical wall portion adapted to be attachable to the base and adapted to extend less than the packaged height of the container, providing an upper surface secured at least in one position to an upper portion of a vertical member, providing at least one second vertical wall portion adapted to extend towards the first vertical wall portion from the upper surface, the vertical members having a horizontally extending channel to support a portion of a load bearing beam adapted to extend between two spaced apart expandable vertical members;

extending the members to an expanded position;

attaching at least some part of an interchangeable and relocatable side walls to an upper part of the height adjustable container during expansion; and attaching at least some other part of the interchangeable and relocatable side walls to the lower part of the height adjustable container during expansion whereby the lower part of the side walls is substantially high enough to accommodate building components, fittings, furniture and fixtures below its height;

wherein when the container is in an unextended position the height of the container is at a reduced height of at least 50% to that of a standard shipping container and when the container is in the extended position the container is at a height equal to that of a habitable area or greater than the height of a standard shipping container and the erected side walls are coaxially aligned to form outer walls having a flat planar surface along the entire surface area of the outer wall.

2. A height adjustable transportable shipping container usable as a building structure, wherein the transportable expandable shipping container houses during transportation within a minimum of two roofs and two floors such that when the transportable expandable shipping container is expanded for use as a building structure the transportable expandable shipping container makes up a minimum area of that of two standard shipping containers, the height adjustable shipping container having:

vertical corner members and at least three interchangeable and relocatable side walls which may be transported at a reduced height as a shipping container and expanded at the receiving end wherein at least some of the vertical corner members expand in length during expansion of the reduced height shipping container and the shipping container is capable to house and to transport therein structural components, such as wall panels, floor, roof and even fittings to erect a building structure that is the equivalent in floor area to that of at least two shipping containers;

at least some part of the interchangeable and relocatable side walls is attached to an upper part of the height adjustable container during expansion and at least some other part of an interchangeable and relocatable side walls is attached to the lower part of the height adjustable container during expansion, the lower part of the side walls is substantially high enough to accommodate building components, fittings, furniture and fixtures below its height: and the vertical members including a horizontally extending channel to support a portion of a load bearing beam adapted to extend between two spaced apart vertical members, wherein further when the container is in an unextended position the height of the container is at a reduced height of at least 50% to that of a standard shipping container and such that when the container is in the extended position the container is at a height equal to that of a habitable area or greater than the height of a standard shipping container and the erected side walls are coaxially aligned to form outer walls having a flat planar surface along the entire surface area of the outer wall.

3. The height adjustable shipping container as claimed in claim 2, wherein the vertical members are vertical rails or columns.

4. The height adjustable shipping container as claimed in claim 2 includes access points for utility services, the access points are situated at the junctures of the upper and lower walls.

5. The height adjustable shipping container as claimed in claim 2, wherein at least part of a wall filling the gap between upper and lower shipping container parts is pulled into place on expansion of the container.

6. The height adjustable shipping container as claimed in claim 2, wherein the floor of the shipping container may act to receive a pourable settable material and may include elements acting as reinforcement for the settable material.

7. The height adjustable shipping container as claimed in claim 6, wherein the reinforcement elements may extend through two adjacent expanded shipping container floors.

8. The height adjustable shipping container as claimed in claim 2, wherein the shipping container corner members may include telescoping portions in which any engagement features in the corner rail top are substantially repeated in the top of each telescoping portion.

9. The height adjustable shipping container as claimed in claim 2, wherein when in the expanded form the corner members remain capable of supporting vertical loads.

10. The height adjustable shipping container as claimed in claim 2, wherein the side panels can be relocated to an outer shell of the erected container to create a combination of external walls, windows and door openings, whereby the panels, windows and doors are interchangeable, and able to create a number of different formats as desired.

11. The height adjustable shipping container as claimed in claim 6, wherein the floor includes spaced apart openings adapted to receive the tines of a fork lift to allow the unerected shipping container to be easily transported and are adapted when the shipping container is erected to used as service ducts.

12. The height adjustable shipping container as claimed in claim 2, wherein the vertical corner members have an open cross section.

13. The height adjustable shipping container as claimed in claim 2, wherein the lower part of the side walls is substantially 0.9 meters high and the upper part of the side walls is substantially 0.3 meters high.

14. The height adjustable shipping container as claimed in claim 12, wherein the vertical corner members have a substantially 'L'-shaped cross section.

15. A transportation system for the transportation, packaging and erection of a transportable height adjustable shipping container usable as a building, the transportable expandable shipping container during a transportation mode houses within a minimum of two roofs and two floors such that when the transportable expandable shipping container in a building mode for use as a building structure the transportable expandable shipping container makes up a minimum area of that of two standard shipping containers, the transportation system including an external building shell transformable from the transportation mode to the building mode, when in the transportation mode the external building shell falls within same floor dimensions and floor area of a shipping container format, the external building shell being height adjustable such that the external shell is adapted to be transformed from the transport mode to the building mode by adjusting the height of the external building shell to a desired height, when in the transportation mode the internal space within the external building shell includes structural components, such as building components, wall panels, floor, roof fittings, furniture and fixtures required to erect and fit out a building structure that is the equivalent in floor area to that of at least two shipping container formats; the external building shell includes:

vertical corner members and at least three interchangeable and relocatable side walls which may be transported at a reduced height as a shipping container and expanded at the receiving end wherein at least some of the vertical corner members expand in length during expansion of the reduced height shipping container;

at least some part of the interchangeable and relocatable side walls is attached to an upper part of the height adjustable container during expansion and at least some other part of an interchangeable and relocatable side walls is attached to the lower part of the height adjustable container during expansion, the lower part of the side walls is substantially high enough to accommodate the structural components, such as building components, wall panels, floor, roof fittings, furniture and fixtures, below its height when in the transportation mode; and the expandable vertical members having a horizontally extending channel to support a portion of a load bearing beam adapted to extend between two spaced apart expandable vertical members, wherein the transportation system when in the transportation mode the external building shell is at a reduced height of at least 50% to that of a standard shipping container and such that when in the building mode the external building shell is at a height equal to that of a habitable area or greater than the height of a standard shipping container and the erected side walls are coaxially aligned to form outer walls having a flat planar surface along the entire surface area of the outer wall.

16. The transportation system as claimed in claim 15, wherein the lower part of the side walls is substantially 0.9 meters high and the upper part of the side walls is substantially 0.3 meters high.

17. The height adjustable shipping container as claimed in claim 15, wherein the vertical corner members have an open cross section.

18. The transportation system as claimed in claim 17, wherein the vertical corner members have a substantially 'L'-shaped cross section.

19. The method of manufacturing a transportable expandable shipping container for use as a building structure as claimed in claim 1, wherein the method includes a further step of relocating the elements forming the shipping container walls during transport elsewhere to and/or within the container after expansion.

20. The height adjustable transportable shipping container usable as a building structure as claimed in claim 2, wherein the elements forming the shipping container walls during transport adapted to be relocated elsewhere within the container after expansion.

* * * * *